US010762999B2

(12) United States Patent
Kaszuba et al.

(10) Patent No.: US 10,762,999 B2
(45) Date of Patent: Sep. 1, 2020

(54) IRRADIATOR APPARATUS AND SYSTEM AND METHOD FOR IRRADIATING A SAMPLE USING X-RAYS

(71) Applicant: BEST THERATRONICS LTD., Ottawa (CA)

(72) Inventors: Wlodzimierz S. Kaszuba, Ottawa (CA); Angela L. Sanders, Ottawa (CA); Jeffery D. Gulis, Clayton (CA)

(73) Assignee: BEST THERATRONICS LTD, Ottawa (CA)

( * ) Notice: Subject to any disclaimer, the term of this patent is extended or adjusted under 35 U.S.C. 154(b) by 111 days.

(21) Appl. No.: 16/144,204

(22) Filed: Sep. 27, 2018

(65) Prior Publication Data

US 2019/0108925 A1 Apr. 11, 2019

Related U.S. Application Data

(60) Provisional application No. 62/569,450, filed on Oct. 6, 2017.

(51) Int. Cl.

| | |
|---|---|
| ***G21K 5/04*** | (2006.01) |
| ***G21K 1/06*** | (2006.01) |
| ***G21K 5/08*** | (2006.01) |
| *G21K 1/10* | (2006.01) |

(52) U.S. Cl.

CPC ..... *G21K 5/04* (2013.01); *G21K 1/06* (2013.01); *G21K 5/08* (2013.01); *G21K 1/10* (2013.01); *G21K 2201/067* (2013.01)

(58) Field of Classification Search

USPC ..... 250/492.1; 378/64

See application file for complete search history.

(56) References Cited

U.S. PATENT DOCUMENTS

| | | | |
|---|---|---|---|
| 6,212,255 | B1 | 4/2001 | Kirk |
| 6,389,099 | B1 | 5/2002 | Gueorguiev |
| 6,452,200 | B1 | 9/2002 | Kotler |
| 6,614,876 | B1 | 9/2003 | Kirk |

(Continued)

FOREIGN PATENT DOCUMENTS

| | | |
|---|---|---|
| EP | 1336973 A1 | 8/2003 |
| EP | 2412388 A1 | 2/2012 |

OTHER PUBLICATIONS

Best Theratronics, product overview, blood & research irradiators—Raycell Mk1, Best Theratronics, Ltd., 2008-2018, 2 pages.

(Continued)

*Primary Examiner* — Kiet T Nguyen

(74) *Attorney, Agent, or Firm* — John C. Brosky; Laba Karki; JanPaul Guzman

(57) ABSTRACT

An irradiator apparatus and system that utilizes a single radiation source, such as X-rays, to irradiate product samples, such as blood, blood products, bone materials, or live laboratory animals, such as mice. The irradiator apparatus and system incorporates a radiation reflector having a moveable reflector portion, and a moving mechanism to allow product container rotation and orientation. In addition, a radiation filter is associated with the single radiation source, such as an X-ray source, to allow optimal dose distribution throughout the irradiated sample and compensate for beam profile asymmetry.

22 Claims, 12 Drawing Sheets

(56) References Cited

U.S. PATENT DOCUMENTS

| | | | | |
|---|---|---|---|---|
| 7,346,147 | B2 | 3/2008 | Kirk et al. | |
| 7,515,686 | B2 | 4/2009 | Kirk | |
| 2004/0264647 | A1 | 12/2004 | Graf et al. | |
| 2012/0140230 | A1* | 6/2012 | Miller | G01N 15/042 15/42 |

OTHER PUBLICATIONS

Best Theratronics, product overview, blood & research irradiators—Raycell Mk2, Best Theratronics, Ltd., 2008-2018, 2 pages.
Best Theratronics, Raycell Mk1 X-ray Blood Irradiator, Best Theratronics, Ltd., 2017-2018, 2 pages.
Best Theratronics, Raycell Mk2 X-ray Blood Irradiator, 2.0 L or 3.5 L Canisters, Best Theratronics, Ltd., 2011, 6 pages.
RS 3400 X-ray Blood Irradiator, Rad Source, 2017, 5 pages.
The RS 3400 X-Ray Blood Irradiator, Rad Source, 2017, 2 pages.
RS 3400 X-ray Blood Irradiator, Rad Source, 2018, 7 pages.
International Search Report and Written Opinion of the International Searching Authority, PCT International Application No. PCT/CA2018/051238, Dec. 21, 2018, 9 pages.

* cited by examiner

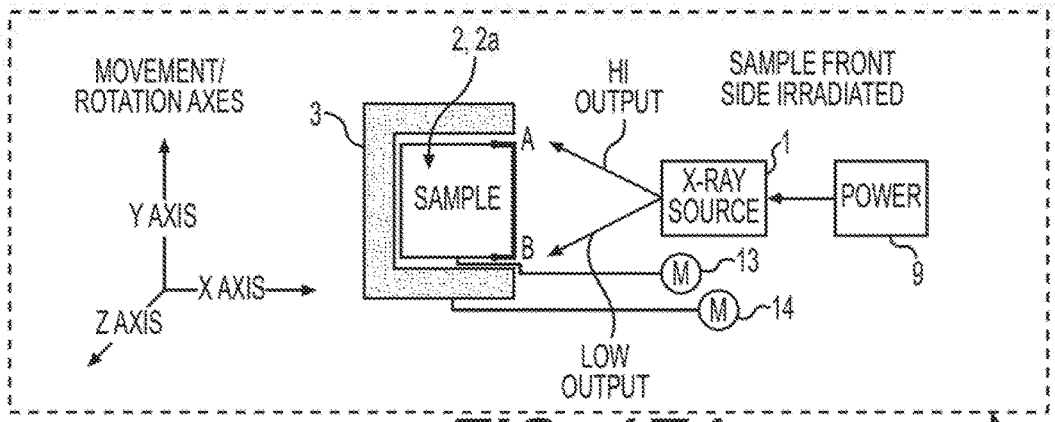
FIG. 1E1
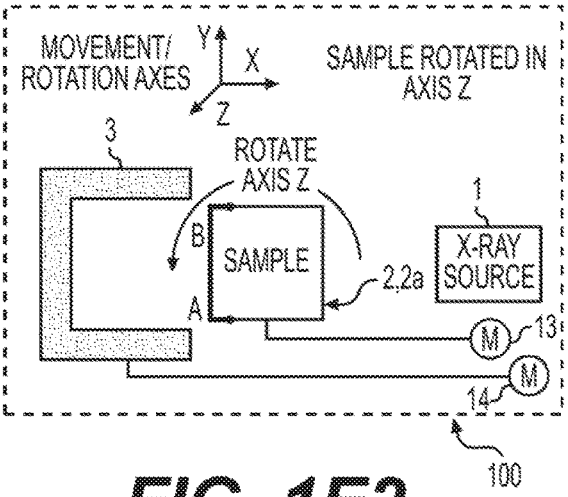
FIG. 1E2
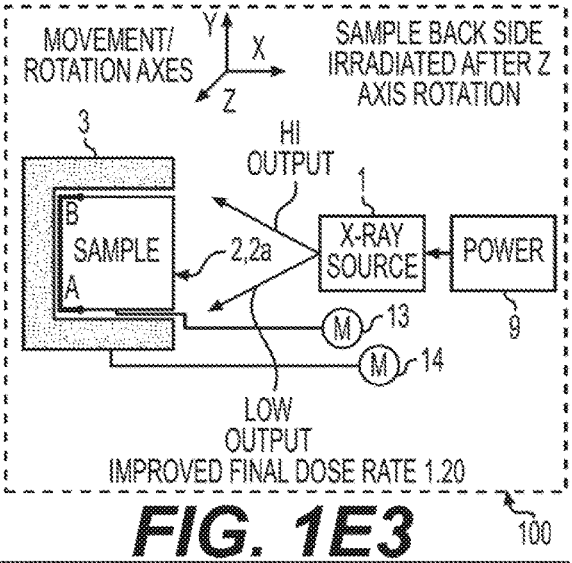
FIG. 1E3
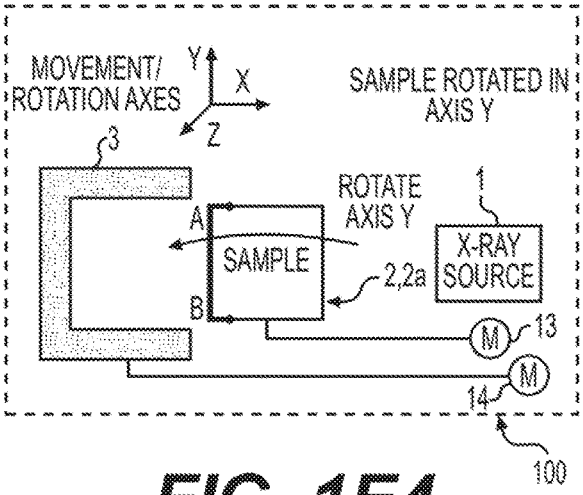
FIG. 1E4
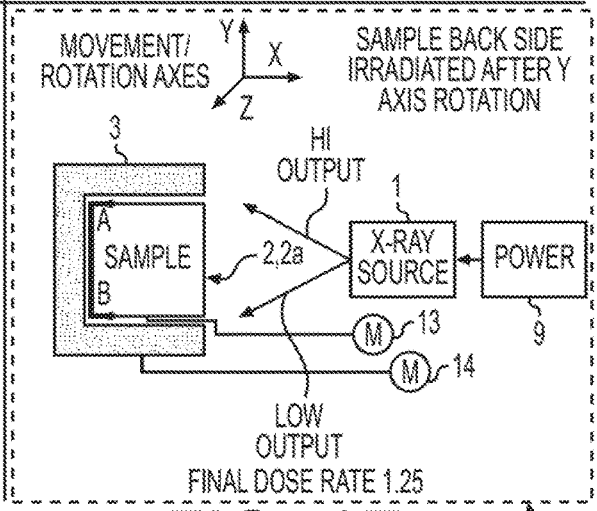
FIG. 1E5

IRRADIATOR APPARATUS AND SYSTEM AND METHOD FOR IRRADIATING A SAMPLE USING X-RAYS

CROSS REFERENCE TO RELATED APPLICATION

This application claims priority under 35 U.S.C. § 119 to U.S. Provisional Patent Application No. 62/569,450, filed on Oct. 6, 2017, hereby incorporated herein by reference in its entirety.

FIELD OF THE INVENTION

The invention generally relates to the field of medical devices, and more particularly to an irradiator apparatus and system utilizing a single radiation source, such as X-rays to irradiate materials.

BACKGROUND ART

In the irradiation of materials, for example, U.S. Pat. No. 6,212,255 to Kirk (Rad Source Technologies) discloses an irradiator having two X-ray sources located in opposing directions to allow sample irradiation from top and bottom simultaneously to provide dose coverage of the sample. A two X-ray source irradiator can be advantageous, such as in promoting alleviating X-ray absorption and attenuation typically associated with using a single radiation source X-ray irradiator. However, a two radiation source X-ray irradiator having two X-ray tubes can be disadvantageous in certain respects, such as its relative size as to suitability for confined locations, more shielding requirements are typically needed for radiation emitted, and the relative complexity of the powering and cooling systems used to operate the two tubes.

Also, a two-source irradiator typically has an irradiator configuration that can limit the effectiveness of an irradiation reflector, as it can be typically be located to the sides of the irradiated product, such as a collar mounted around the sample canister to reflect the X-rays, such as disclosed in U.S. Pat. No. 6,614,876 to Kirk. In addition, an X-ray beam from a two-source irradiator can exhibit a profile asymmetry and dose non-uniformity in irradiated samples, and precise sample irradiation typically requires a high dose uniformity throughout the irradiated sample, for example.

In U.S. Pat. No. 6,389,099 to Gueorguiev an irradiation system is disclosed that uses a single X-ray source and a radiation reflector comprised of low Z material, high density material, with the reflector being positioned to receive radiation penetrating and exiting the product sample to reflect the radiation back to the product sample. Such disclosed single source irradiation system can promote addressing irradiator complexity typical with plural radiation sources and can advantageously use the reflector to allow X-ray radiation to be reflected back to the product sample being irradiated, such as can help compensate partly for the radiation attenuated from the top of the product sample. However, such single source irradiation system is believed to not fully address providing dose uniformity in the irradiated sample in that, for example, X-ray beam profile asymmetry may exist, such as an anode heel effect, typically at the sample edges and the efficiency of the X-ray reflection may be not as efficient for deeper product sample containers, such as can result in a lack of dose coverage at the bottom of the product sample.

Therefore, an irradiator apparatus or system utilizing a single radiation source would be desirable, such as having a single X-ray source, to irradiate materials. It would further be desirable to have a single X-ray source irradiator apparatus or system that has a radiation reflector in conjunction with a moving mechanism to allow product sample container rotation and reflector movement to facilitate radiation distribution. In addition, it would be desirable for an irradiator apparatus or system to have a radiation filter associated with the X-ray source to facilitate allowing optimal dose distribution throughout the irradiated product sample.

It is also desirable to provide an irradiator apparatus or system that can provide a relatively better dose uniformity throughout the irradiated material, while enabling the irradiator apparatus or system to be compact and portable.

Thus, a single radiation source irradiator apparatus and system to deliver radiation to a product sample addressing the aforementioned needs is desired.

SUMMARY OF INVENTION

Embodiments of the present invention include an irradiator apparatus or system having a single radiation source, such as a single X-ray source, to deliver radiation to a product sample to be irradiated, a reflector assembly to reflect radiation delivered by the single radiation source to the product sample back to the product sample, a sample holder associated with the reflector assembly configured to hold a product sample container or canister that receives the product sample to be irradiated, and a rotation device associated with the sample holder and configured to rotate, flip or orient the product sample container to a plurality of positions or orientations to deliver radiation to the product sample at each of the plurality of positions or orientations to facilitate a substantially uniform irradiation of the product sample and a substantially uniform radiation exposure delivered to the product sample providing a substantial dose profile uniformity in the irradiated product sample. The rotation device in embodiments of the irradiator apparatus or system can be configured with the reflector assembly to flip, orient or rotate the rotatable product sample container to facilitate delivery of radiation to the product sample at different positions or orientations of the rotatable sample container.

Embodiments provide methods for product sample irradiation including providing a plurality of radiation deliveries to a product sample delivered at each of a plurality of positions or orientations of the product sample in an irradiator apparatus or system. The method includes providing a plurality of irradiation deliveries from a single radiation source to a product sample, such as desirably a two-step radiation delivery to the product sample. The plurality of radiation deliveries includes initially positioning a product sample to be irradiated in a product sample container or canister, positioning the product sample container or canister positioned in association with a sample holder at an initial position or orientation in the irradiator apparatus or system, irradiating the product sample by delivering radiation from a single radiation source, such as a single X-ray source, to the product sample positioned at the initial position or orientation, reflecting the radiation delivered to the product sample at the initial position or orientation by a reflector assembly back to the product sample, successively positioning the product sample in the product sample container or canister in the sample holder at a predetermined one or more other positions or orientations in the irradiator apparatus or system by flipping, rotating or orienting the product sample container to a corresponding one other position or orientation, successively delivering to the product sample at each other position or orientation of the plurality of positions or orientations radiation from the single radiation source, such as an X-ray source, to the product sample positioned at a corresponding one of each other position or orientation, and reflecting by the reflector assembly the radiation delivered to the product sample positioned at the corresponding one of each other position or orientation of the plurality of positions or orientations back to the product sample, the plurality of radiation deliveries to the product sample positioned at the initial position or orientation and at the one or more other positions or orientations of the plurality of positions or orientations delivering radiation to the product sample facilitating a substantially uniform irradiation of the product sample and a substantially uniform radiation exposure delivered to the product sample providing a substantial dose profile uniformity in the irradiated product sample. Hence, beam profile asymmetry and the lack of dose profile uniformity can be better resolved by employing embodiments of the methods for irradiating a product sample including a plurality of radiation deliveries at each of a plurality of positions or orientations of the product sample in an irradiator apparatus or system.

In embodiments of methods for irradiating a product sample, the methods can also desirably include moving at least a part of or all of the reflector assembly away from the product sample container or canister to enable positioning or orienting the product sample container or canister, such as by rotating or orienting the product sample container or canister including the product sample to the initial orientation or position or to a corresponding other one of a predetermined plurality of positions or orientations for irradiation of the product sample. Hence, the beam profile asymmetry and the lack of dose profile uniformity can be better resolved by embodiments of methods for sample irradiation including a plurality of radiation deliveries.

Also, embodiments of methods can include desirably include associating the sample holder with a rotation device and rotating the sample holder by the rotation device to flip, orient or rotate the rotatable product sample container to position or orient the product sample to facilitate delivery of radiation to the product sample at different positions or orientations. Also, embodiments of methods can desirably include providing the sample holder for the product sample container as a part of the reflector assembly to flip, orient or rotate the product sample container to facilitate delivery of radiation to the product sample at different positions or orientations of the rotatable product sample container.

Also, embodiments of the irradiator apparatus can desirably include a reflector assembly to reflect the delivered radiation, the reflector assembly including or formed of material having a low-Z number, Z being the atomic number of the material, and can desirably include the reflector assembly being formed of or including material having high density, d, for efficient X-ray reflection. Such materials of a low or a relatively low Z number and having a high or relatively high density can facilitate a scattered radiation beam to be reflected towards the product sample, and can therefore promote reducing the time of radiation exposure of the product sample. Examples of low Z materials include but are not limited to beryllium, boron, carbon or some combination thereof, and higher density forms of these materials are desirable, but other factors to consider in material selection can include, for example, availability, cost, safety, etc. of the material, and as can depend on the use or application, and should not be construed in a limiting sense. Embodiments of a reflector assembly in embodiments of an irradiator system and apparatus can desirably include a reflector assembly that is movable in full or in part for the irradiation to allow the product sample container or canister and the product sample positioned in a product sample container or canister to rotate or move to position or orient the product sample for irradiation. For example, the product sample container or canister can be placed inside a reflector assembly and irradiated from one side, then the irradiation cycle is paused while the reflector assembly is moved out of the way for rotation or orientation of the product sample container or canister including the product sample, and then the reflector assembly is moved back and positioned over or in a surrounding relation to the product sample container or canister including the product sample to then be irradiated from the other side.

Embodiments of an irradiator apparatus or system can desirably include an X-ray filter positioned at the X-ray source output to facilitate better dose uniformity in the irradiated product sample. The X-ray filter is desirably formed of, for example, copper or other suitable material that can provide the desired filtering and, desirably, the X-ray filter has a suitable configuration or profile, such as flat, stepped or domed configuration or profile, as can depend on the irradiation application, and should not be construed in a limiting sense. For example, a metallic X-ray filter in embodiments of irradiation apparatuses and systems can desirably have a step profile or configuration at the filter's center, as can allow for better dose uniformity in the irradiated product sample.

Embodiments also include methods for controlling irradiation of a product sample in an irradiator system or apparatus, the methods including providing a controlled workflow to control a radiation amount to be delivered to a product sample at each of a plurality of radiation deliveries by a single radiation source, such as a single X-ray source, to provide a total radiation amount delivered to the product sample for the plurality of radiation deliveries having a substantial dose profile uniformity in the irradiated product sample, determining a beam on-time in the controlled workflow for each of the plurality of radiation deliveries corresponding to a radiation amount to be delivered to a product sample at each of a plurality of radiation deliveries by a single radiation source, determining in the controlled workflow a position or orientation of the product sample for each of the plurality of radiation deliveries, synchronizing in the controlled workflow movements of a sample holder configured to hold the product sample to be irradiated, movements of at least a portion of a reflector assembly, the reflector assembly configured to reflect radiation delivered by the single radiation source to the product sample back to the product sample, and the determined beam on-time for each of the plurality of radiation deliveries to deliver radiation to the product sample at each corresponding one or the plurality of radiation deliveries, and controlling the single radiation source in the controlled workflow to deliver radiation to the product sample for each corresponding determined beam on-time for each of the plurality of radiation deliveries at each corresponding determined position or orientation of the product sample to provide a substantially uniform irradiation of the product sample and a substantially uniform radiation exposure delivered to the product sample to provide a substantial dose profile uniformity in the irradiated product sample.

Embodiments of methods including a controlled workflow to control a radiation amount to be delivered to a product sample desirably include on-time control and synchronization of radiation delivery with sample holder and reflector assembly movement. Embodiments of the controlled workflow to control a radiation amount to be delivered to a product sample can also include timer setting and irradiator and radiation dose data recording, data transfer or the radiation delivery through a network, and data printing and reporting of the radiation delivery.

These and other features of the present invention will become readily apparent upon further review of the following specification and drawings.

DESCRIPTION OF THE DRAWINGS

FIG. 1E1, FIG. 1E2, FIG. 1E3, FIG. 1E4 and FIG. 1E5 are schematic top view illustrations of an embodiment of an a irradiator apparatus or system illustrating an exemplary plurality of delivery positions or orientations, radiation deliveries at these positions or orientations and rotations or orientations of the product sample in relation to an X, Y and Z coordinate axis system to position or orient the product sample at a plurality of radiation positions or orientations for irradiation of the product sample to provide a substantially uniform dose distribution throughout the volume or the product sample, according to the present invention.

FIG. 5 is an exemplary process flow diagram of a method for irradiation a product sample in conjunction with an embodiment of a method for controlling irradiation of a product sample in an irradiator system or apparatus including a controlled workflow to control a radiation amount to be delivered to a product sample, illustrating embodiments of operation methods of the irradiator apparatus or system for product samples irradiated in a controlled workflow, desirably including beam On-time control, synchronization with sample holder and reflector assembly movement, and dose data recording and processing through a network, according to the present invention.

Unless otherwise indicated, similar reference characters denote corresponding features consistently throughout the attached drawings.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses, and/or methods described herein will likely suggest themselves to those of ordinary skilled in the art. Also, descriptions of well-known functions and constructions are omitted to increase clarity and conciseness.

Figure 1A:
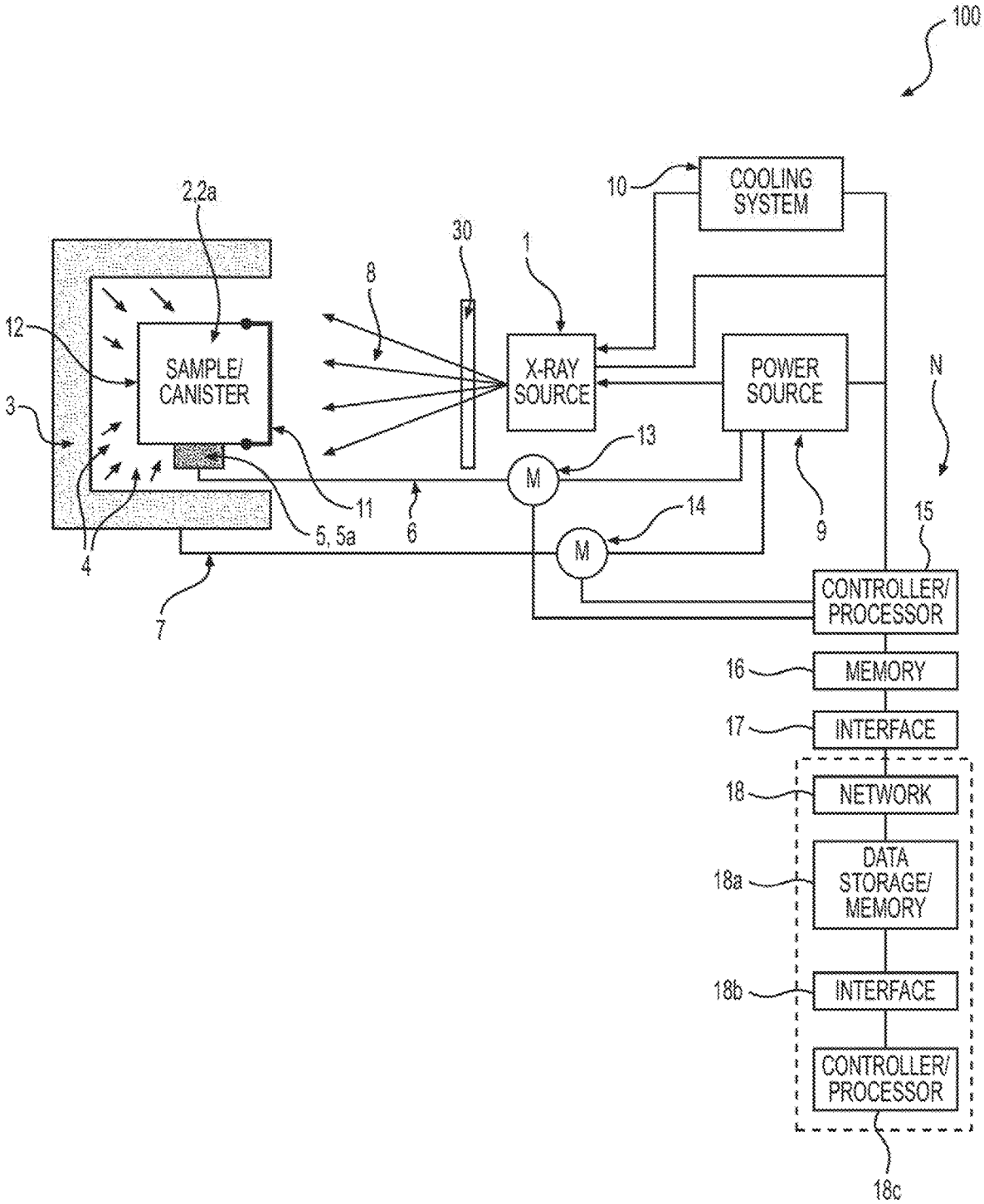
FIG. 1A is an embodiment of a schematic illustration of an irradiator apparatus or system incorporating a single radiation source, such as an X-ray tube, and a filter, positioned in facing relation to a product sample positioned within a moveable reflector assembly, in conjunction with an embodiment of a controlled workflow network, according to the present invention.

FIG. 1A illustrates schematically an exemplary construction of an embodiment of an irradiator apparatus or system 100 and various components of the irradiator apparatus or system 100. In the embodiment of a schematic illustration of an irradiator apparatus or system 100 of FIG. 1A there is included a single radiation source 1, such as an X-ray tube 1, and a radiation filter 30, such as an X-ray filter 30, positioned in facing relation to a product sample 2 to be irradiated, such as positioned in a product sample canister or product sample container 2*a*, illustrated as being positioned within a moveable reflector or reflector assembly 3. A suitable cooling system 10 is in communication with the single radiation source 1 to cool the single radiation source 1 for radiation delivery, with a suitable power source 9 being in communication with the single radiation source 1 and other components of the irradiation apparatus or system 100 to provide operating power to the single radiation source 1 for radiation delivery and to operate other components of the irradiator apparatus or system 100.

In FIG. 1A, the power source 9, for example, powers a suitable motor 14 for movement of at least a part of the reflector assembly 3, the motor 14 being in communication with a suitable driver, such as a suitable shaft assembly 7 to drive movement of at least a part of the reflector assembly 3, such as toward or away from the product sample container or canister 2*a* that includes the product sample 2. Also, for example, the power source 9 desirably provides power to a suitable motor 13 that is communicatively connected to or associated with a sample holder 5, such as through a shaft assembly 6, communicatively associated with a rotation device 5*a* to rotate, flip or orient the product sample canister or container 2*a* and the product sample 2 to a plurality of positions or orientations to deliver radiation to the product sample 2 selectively positioned at corresponding ones of the plurality of positions or orientations to facilitate a substantially uniform irradiation of the product sample 2 and a substantially uniform radiation exposure delivered to the product sample 2 to provide a substantial dose profile uniformity in the irradiated product sample 2.

The irradiator apparatus or system 100 desirably also includes a suitable controller/processor 15 that is communicatively associated with a suitable memory 16 for operation and control of the irradiator apparatus or system 100 and recording and monitoring of the radiation delivery process to the product sample 2, the controller/processor 15 and the suitable memory 16 can be powered by a suitable power source, such as the power source 9. The controller/processor 15 that is communicatively associated with the memory 16 can be associated with or a part of a network N for providing a controlled workflow for radiation delivery by embodiments of irradiator apparatus or systems, such as the irradiator apparatus or system 100. As illustrated in FIG. 1A, the network N can include the controller/processor 15 and the memory 16, and a suitable interface 17 as can include one or more of a suitable display, keyboard or touchpad, for example, for communication and control of the radiation delivery. The network N can include one or more of an external or an internal network 18, communicating with the controller/processor 15 and the memory 16 though the interface 17. The external or internal network 18 can include one or more networks 18 as can include a data storage/memory 18*a* as can communicate with one or more controllers/processors 18*c* through one or more suitable interfaces 18*b*, as can include one or more of a suitable display, keyboard or touchpad, for example. The controlled workflow as can be implemented through the network N to control a radiation amount to be delivered to the product sample 2, desirably including beam on-time control, synchronization with sample holder and reflector assembly movement, and dose data recording and processing through the network 18, for example, is discussed further herein with reference to FIG. 5.

The controller/processor 15, the memory 16, the internal and external network 18 including the data storage/memory 18*a* as can communicate with one or more controller/processors 18*c* through one or more suitable interfaces 18*b* for a controlled workflow for the radiation delivery by the irradiator apparatus or system 100, can represent, for example, a stand-alone computer, computer terminal, portable computing device, networked computer or computer terminal, or networked portable device, such as a cell phone, tablet, pad or other wireless communication device. Data and control information for the radiation delivery, monitoring and recording can be entered into the network N for radiation delivery by the irradiator apparatus or system 100 by a user or operator of the irradiator apparatus or system 100 or the associated network N via any suitable type of user interface 17, 18*b*, and can be stored in computer readable memories, such as the memory 16 and the data storage/memory 18*a*, which may be any suitable type of computer readable and programmable memory. Calculations, processing and analysis are performed by the controller/processor 15 or the controller/processor 18*c* or other processors of system components of the irradiator apparatus or system 100 and the associated network N, which can be any suitable type of computer processor, and can be displayed to the user on the interface display of the interface 17, 18*b*, either of which can be any suitable type of computer/processor or networked portable device, as can have a suitable display, for example.

The controller/processor components of the irradiator apparatus or system 100 and of the associated network N including the controller/processor 15, the controller/processor 18*c* and other controllers/processors of the network N can be associated with, or incorporated into, any suitable type of computing device, for example, a personal computer or a programmable logic controller (PLC) or an application specific integrated circuit (ASIC) as can include hardware, software and firmware for the radiation delivery, monitoring and recording process. The interface/display 17, 18*b*, the controller/processor components of the irradiator apparatus or system 100 as can include the associated network N, including the controller/processor 15, the controller/processor 18*c*, the memory 16 and the data storage/memory 18*a* of the network 18, and any associated computer readable media are in communication with one another by any suitable type of data bus or other wired or wireless communication, as is well known in the art.

Examples of computer readable media include a magnetic recording apparatus, non-transitory computer readable storage memory, an optical disk, a magneto-optical disk, and/or a semiconductor memory (for example, RAM, ROM, etc.). Examples of magnetic recording apparatus that may be used as or in addition to memory 16, the data storage/memory 18*a* and other data storage components of the irradiator apparatus or system 100 and the associated network N, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Figure 1B:
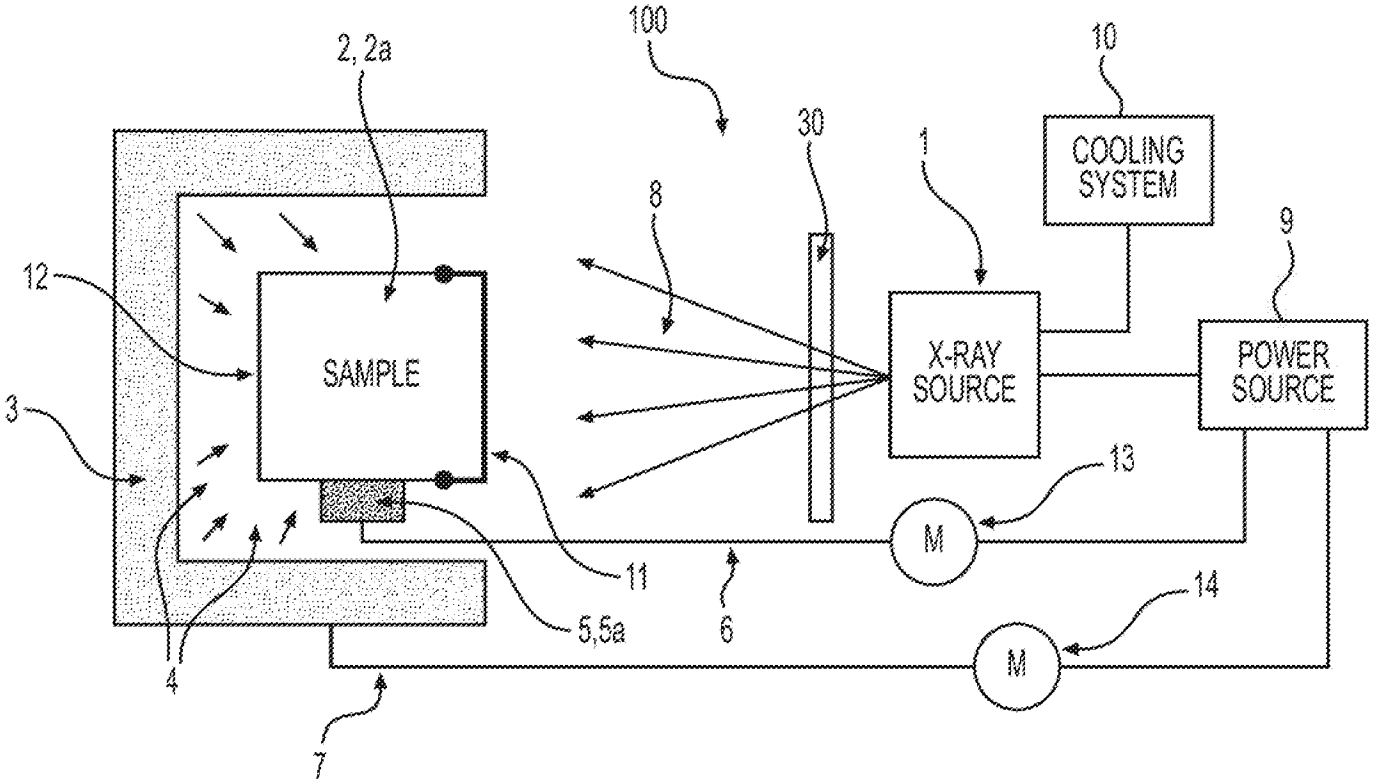
FIG. 1B is an embodiment of a schematic illustration of an irradiator apparatus or system incorporating a single radiation source incorporating an X-ray tube with a product sample positioned inside the reflector assembly and a front side of the product sample being irradiated by radiation from the X-ray-tube, according to the present invention.

FIG. 1B illustrates is an embodiment of a schematic illustration of the irradiator apparatus or system 100 incorporating a single radiation source 1, such as incorporating an X-ray tube 1, with a product sample 2 in the product sample container or canister 2*a* positioned inside the reflector assembly 3 being irradiated by radiation from the single radiation source 1, such as the X-ray-tube 1. In FIG. 1B, the X-ray tube 1 is facing a front side 11 of the product sample container and the product sample 2 to deliver radiation to the product sample 2 through the front side 11 to irradiate the product sample 2, the radiation passing though the radiation filter 30, such as the X-ray filter 30. The reflector assembly 3 reflects X-rays, or other suitable radiation, that has been provided in a beam 8 delivered by the single radiation source 1, that has been filtered by the radiation filter 30, such as the X-ray filter 30, and provided to the product sample 2 through its front side 11, for example, back to the product sample 2. The sample holder 5 associated with the reflector assembly 3 is configured to hold a product sample canister or container 2*a* that receives the product sample 2 to be irradiated. The X-ray beam 8 is partly absorbed by product sample 2 at the front side 11 and the remaining delivered radiation is partly scattered and reaches the reflector assembly 3 which results in a reflected X-ray beam 4 being delivered to the product sample 2 from a rear side 12 of the product sample container 2*a* that includes the product sample 2.

After a first of a plurality of irradiations of the product sample 2, such as illustrated in FIG. 1B, at a first position or orientation, such as a position or orientation having the front side 11 of the product sample canister or container 2*a* including the product sample 2 being positioned in facing relation to the single radiation source 1, it is desirable to rotate the product sample container 2*a* including the product sample 2 to other of a plurality of positions for radiation delivery to the product sample 2. In this regard, a rotation device 5*a* is associated with the sample holder 5 and configured to selectively rotate, flip or orient the product sample canister or container 2*a* and the product sample 2 to a plurality of positions or orientations to deliver radiation to the product sample 2 positioned at each of the plurality of positions or orientations to facilitate a substantially uniform irradiation of the product sample 2 and a substantially uniform radiation exposure delivered to the product sample 2 providing a substantial dose profile uniformity in the irradiated product sample 2.

Figure 1C:
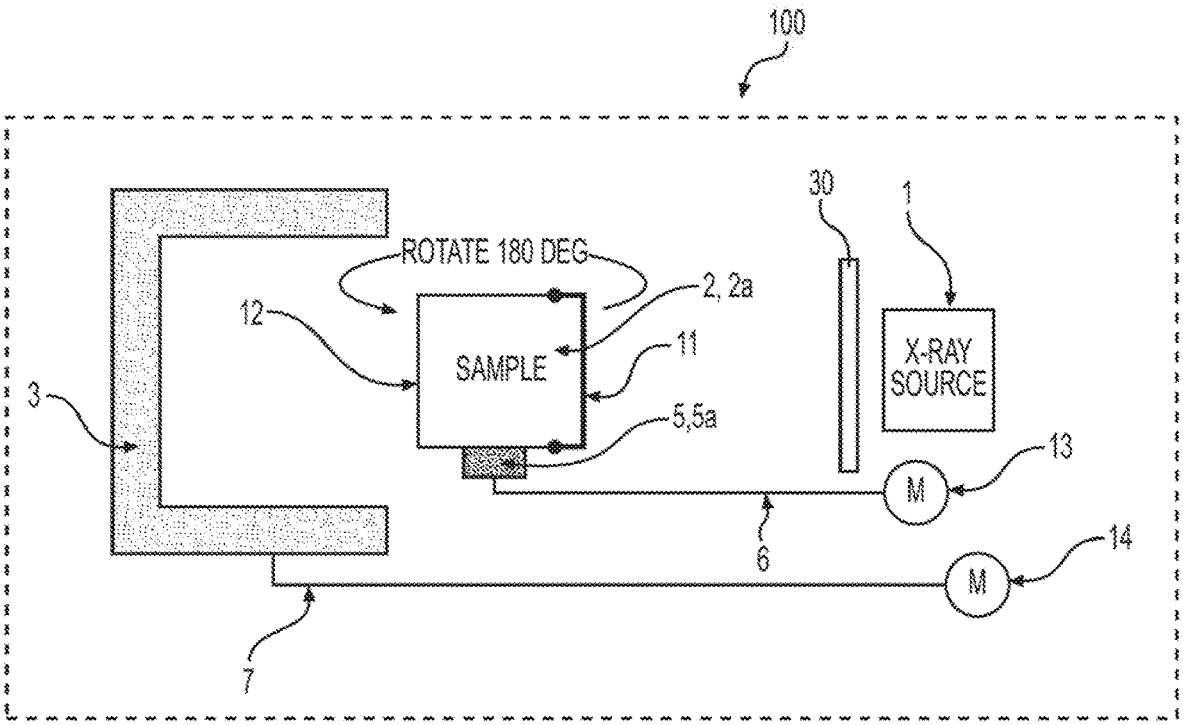
FIG. 1C is an embodiment of a schematic illustration of an irradiator apparatus or system incorporating a single radiation source incorporating an X-ray tube with a product sample being positioned outside of the reflector assembly and the product sample being rotated by one hundred eighty (180) degrees from the front side position of the product sample, according to the present invention.

Referring to FIG. 1C, there is shown an embodiment of a schematic illustration of an irradiator apparatus or system 100 incorporating the single radiation source 1, such as incorporating an X-ray tube 1, with the product sample 2 in the product sample canister or container 2*a* being positioned outside of the reflector assembly 3 to enable the product sample 2 in the product sample canister or container 2*a* to be positioned or oriented an another one of a plurality of positions or orientations for irradiation of the product sample 2. In this example of FIG. 1C, the product sample and the product sample canister or container 2*a* are being rotated by one hundred eighty (180) degrees from the front side 11 position of the product sample canister or container 2*a* including the product sample 2 to the rear side 12 of the product sample container 2*a* including the product sample 2. The rotation device 5*a* in embodiments of the irradiator apparatus or system 100 can be configured with the reflector assembly 3 to flip, orient or rotate the product sample container 2*a* to facilitate delivery of radiation to the product sample 2 at different positions or orientations of the rotatable product sample canister or container 2*a*.

As illustrated in FIG. 1C, the sample holder 5 to position or orient the product sample container 2*a* including the product sample 2 for delivery of radiation is rotated or oriented by the rotation device 5*a*. The rotation device 5*a* is associated with the shaft assembly 6 and the rotation or orientation movement of the rotation device 5*a* is powered by the motor 13, such as a stepper motor 13, desirably, in this case for a rotation of the product sample container 2*a* including the product sample 2 one hundred eighty (180) degrees so that the rear side 12 of product sample container 2*a* including the product sample 2 is now positioned in facing relation to the radiation beam 8 generated by the single radiation source 1, for example. In FIG. 1C, to enable rotation of the product sample container 2*a* including the product sample 2, the reflector assembly 3 is moved by shaft assembly 7 powered by the motor 14, such as using a stepper motor 14, to move at least a first part or portion of the reflector assembly 3 away from the product sample container 2*a* including the product sample 2. Moving at least a portion of the reflector assembly 3 away from the product sample container 2*a* including the product sample 2 provides a space or area within the irradiator apparatus or system 100 to enable the rotation device 5*a* associated with the sample holder 5 that holds the product sample canister or container 2*a* or the product sample 2, to rotate, flip or orient the product sample canister or container 2*a* and the product sample 2 to another of a plurality of radiation delivery positions or orientations, such as to rotate the product sample 2 by one hundred eighty (180) degrees in this case, such that the rear side 12 of the product sample container 2*a* and the product sample 2 is positioned in facing relation to the single radiation source 1 for radiation delivery at this another of a plurality of radiation delivery positions or orientations.

Also, it is desirable that the described motor movement of the reflector assembly 3 through the shaft assembly 7 by the motor 14 and the described motor movement of the rotation device 5*a* associated with the sample holder 5 though the shaft assembly 6 by the motor 13 be implemented in an automated systems of the Network N, such as under control of the controller/processor 15, or other suitable automated control, for example, as such automated control can enhance the radiation throughput delivered to the product sample 2. However, manual movement of the rotation device 5*a* associated with the sample holder 5 though the shaft assembly 6 and manual movement of the reflector assembly 3 through the shaft assembly 7 can also be performed, either with or without the use of the motors 13 and 14, as can be desirable for certain uses or applications, and, therefore, the manner of movement of the reflector assembly 3 and the rotation device 5*a* associated with the sample holder 5 should not be construed in a limiting sense.

Figure 1D:
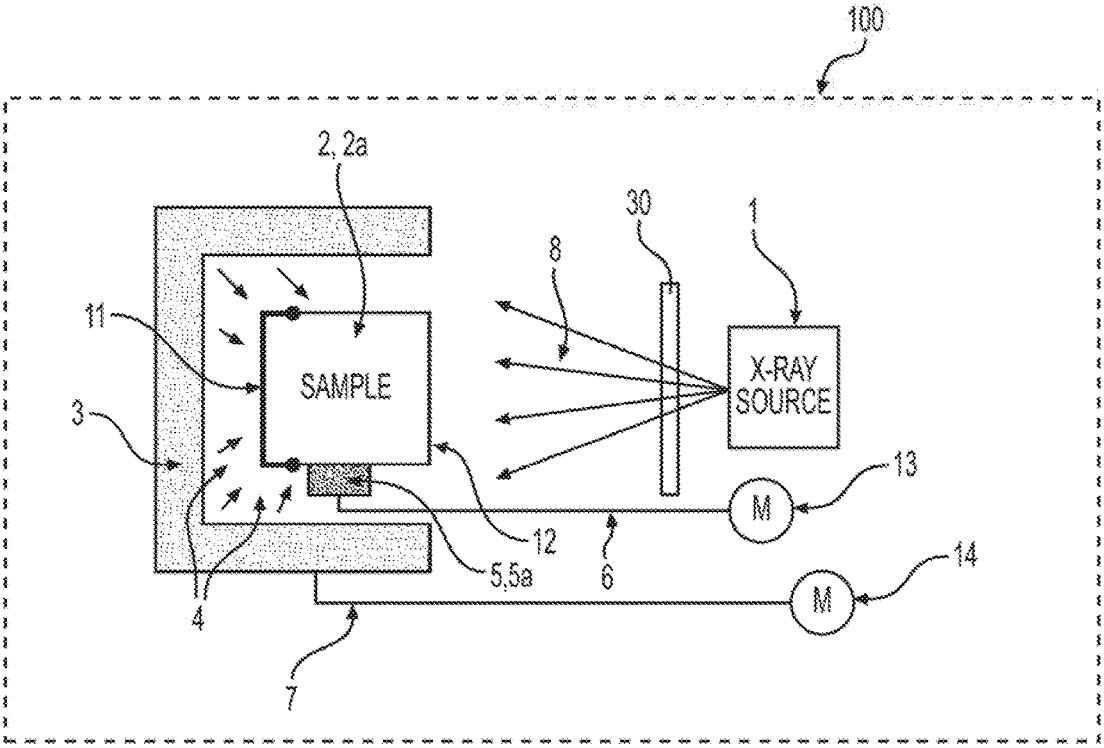
FIG. 1D is an embodiment of a schematic illustration of an irradiator apparatus or system incorporating a single radiation source incorporating an X-ray tube with a product sample positioned inside the reflector assembly and a back side of the product sample being irradiated by radiation from the X-ray-tube, according to the present invention.

Referring to FIG. 1D, there is illustrated a schematic illustration of an embodiment of an irradiator apparatus or system 100 incorporating the single radiation source 1, such as incorporating an X-ray tube 1, and illustrates the product sample 2, after being rotated as described in FIG. 1C, then being irradiated by radiation from the X-ray-tube 1, with the product sample canister or container 2*a* including the product sample 2 positioned inside the reflector assembly 3 and the back or rear side 12 of the product sample container 2*a* including the product sample 2 positioned in facing relation to the radiation source 1 for radiation delivery to the product sample 2 through the back or rear side 12. Prior to radiation delivery by the single radiation source 1 at the radiation delivery position having the back or rear side 12 of the product sample canister or container 2*a* including the product sample 2 positioned in facing relation to the single radiation source 1, the reflector assembly 3 is returned to its initial position or radiation delivery position, as illustrated in FIG. 1D, the reflector assembly 3 covering or being positioned in surrounding relation to the fully rotated product sample container 2*a* including the product sample 2.

Continuing with reference to FIG. 1D, the radiation beam 8, such as the X-ray beam 8, is applied to the product sample 2 from the back or rear side 12 allowing back irradiation of the product sample 2. In FIG. 1D, the X-ray tube 1 is facing the back or rear side 12 of the product sample container 2*a* and the product sample 2 to deliver radiation to the product sample 2 to irradiate the product sample 2, the radiation passing though the radiation filter 30, such as the X-ray filter 30. The reflector assembly 3 reflects X-rays providing the radiation in the beam 8 delivered by the single radiation source 1, filtered by the radiation filter 30, such as the X-ray filter 30, to the product sample 2 back to the product sample 2. The sample holder 5 associated with, as can be integrated with, the reflector assembly 3 is configured to hold a product sample canister or container 2*a* that receives the product sample 2 to be irradiated and the product sample 2.

In the irradiation of the product sample 2 in a second radiation delivery position of FIG. 1D, the X-ray beam 8 is partly absorbed by the product sample 2 at the back or rear side 12 and the remaining delivered radiation is partly scattered and reaches the reflector assembly 3 which results in a reflected X-ray beam 4 being delivered to the product sample 2 in a direction toward the front side 11 of the product sample container 2*a* and the product sample 2, in that the product sample container 2*a* and the product sample 2 in FIG. 1D has been rotated or oriented from the initial or first radiation delivery position or orientation of FIGS. 1A and 1B one hundred eighty (180) degrees to a second radiation delivery position or orientation of FIG. 1D of a plurality of radiation delivery positions or orientations, for example. Irradiation of the product sample 2 by the single radiation source 1 at a plurality of radiation delivery positions or orientations, such as the first radiation delivery position or orientation illustrated in FIG. 1B and at the second radiation delivery position or orientation illustrated in FIG. 1D, facilitates a substantially uniform irradiation from the front side 11 to the back or rear side 12 of the product sample 2, and compensates for the product sample 2 attenuation of X-ray beam 8 after a short depth penetration.

Referring to FIG. 1E1, FIG. 1E2, FIG. 1E3, FIG. 1E4 and FIG. 1E5 there are illustrated top views of schematic illustrations of an embodiment of an irradiator apparatus or system 100 illustrating a plurality of delivery positions or orientations of the product sample canister or container 2*a* including the product sample 2 and positioning or orienting the product sample canister or container 2*a* including the product sample 2 at corresponding positions or orientations for radiation delivery, with reference to an X, Y and Z coordinate axis system, to provide a substantially uniform dose distribution throughout the volume of the product sample 2.

Continuing with reference to FIG. 1E1, the product sample canister or container 2*a* including the product sample 2 in FIG. 1E1 is in a first position or orientation and radiation is delivered to the product sample 2 in this first position or orientation, such as described with reference to FIG. 1A and FIG. 1B for example. Then, in FIG. 1E2, the product sample canister or container 2*a* including the product sample 2 is rotated or oriented one hundred eighty (180) degrees from the first position or orientation to a second position or orientation for radiation delivery, such as described with reference FIG. 1C, for example. After the product sample canister or container 2*a* including the product sample 2 is placed in this second position or orientation, such as by being rotated or oriented in a Z axis direction, radiation is delivered to the product sample 2 in this second position or orientation as illustrated in FIG. 1E3, such as described with reference to FIG. 1D, for example.

Figure 4A:
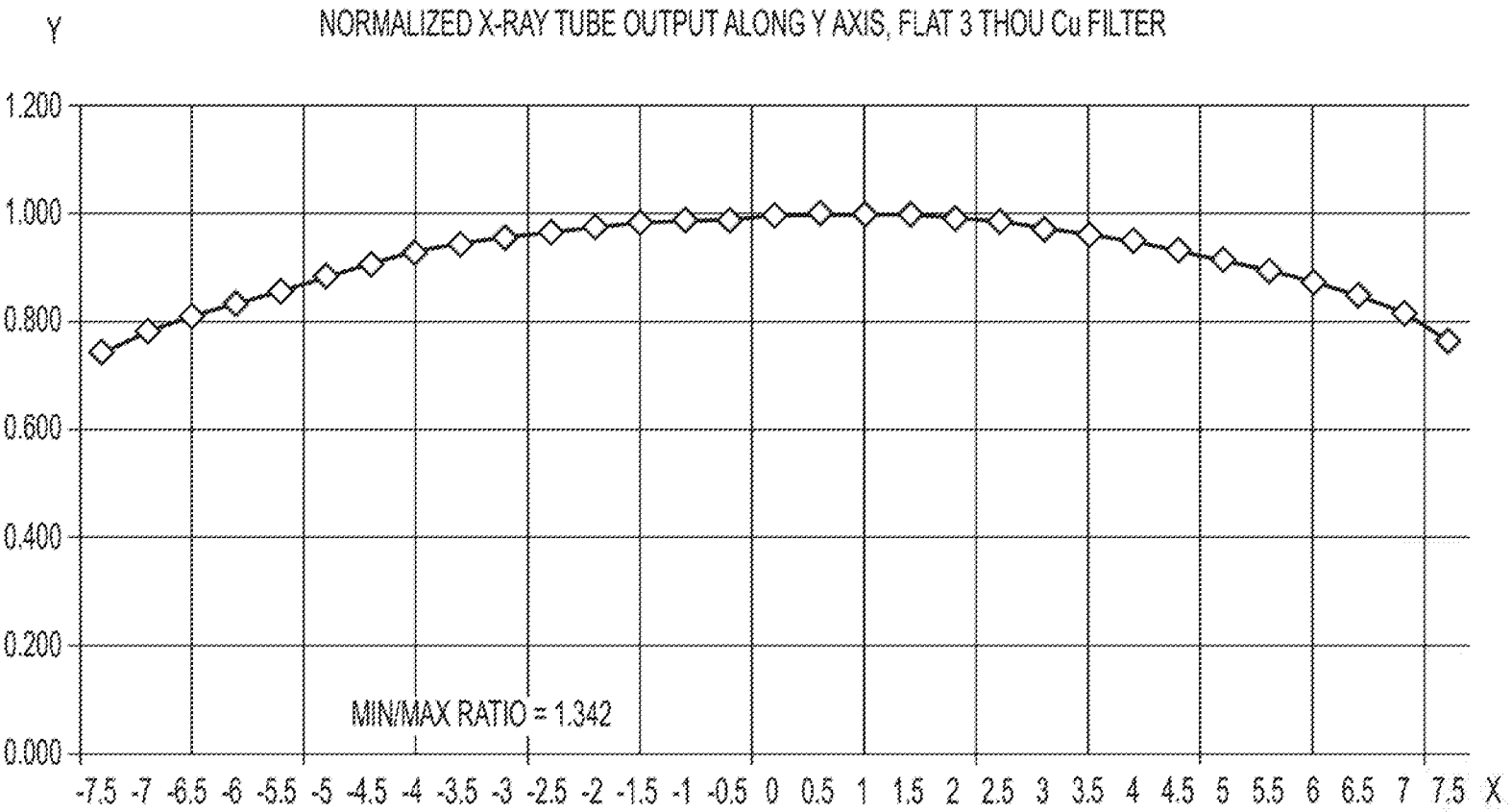
FIG. 4A is a graphic illustration of a lateral dose profile of irradiation in a plastic block delivered using an embodiment of an irradiator apparatus or system having a single X-ray tube and an X-ray filter of a flat filter shape, profile or configuration, illustrating a dose higher at center and lower at edges of the irradiated plastic block, according to the present invention.
Figure 4B:
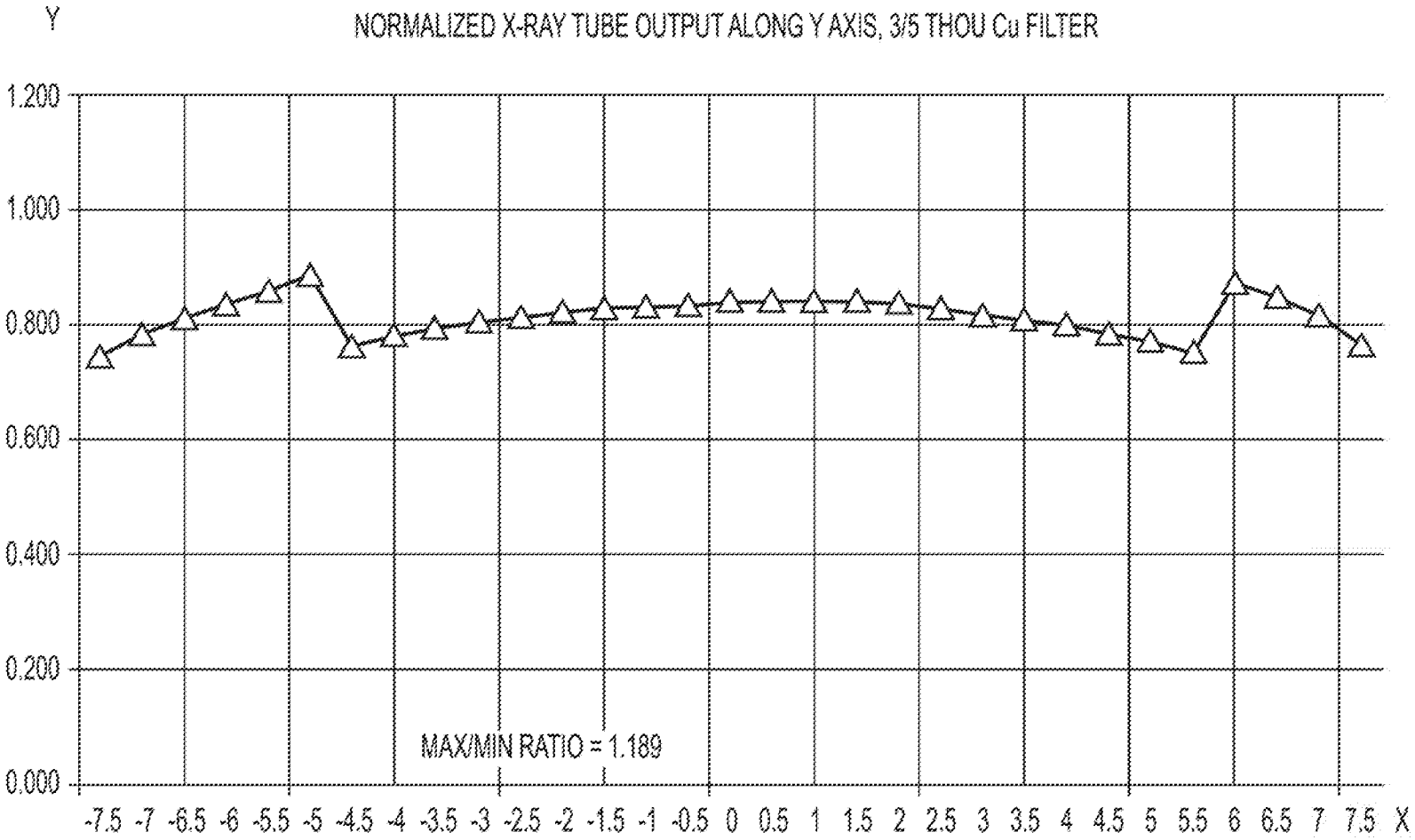
FIG. 4B is a graphic illustration of a theoretical lateral dose profile of irradiation in a plastic block as delivered using an embodiment of an irradiator apparatus or system having a single X-ray tube and an X-ray filter of a step-filter shape, profile or configuration, illustrating a relatively improved dose uniformity in the irradiated plastic block over that using an X-ray filter of a flat filter shape, profile or configuration, according to the present invention.
Figure 5:
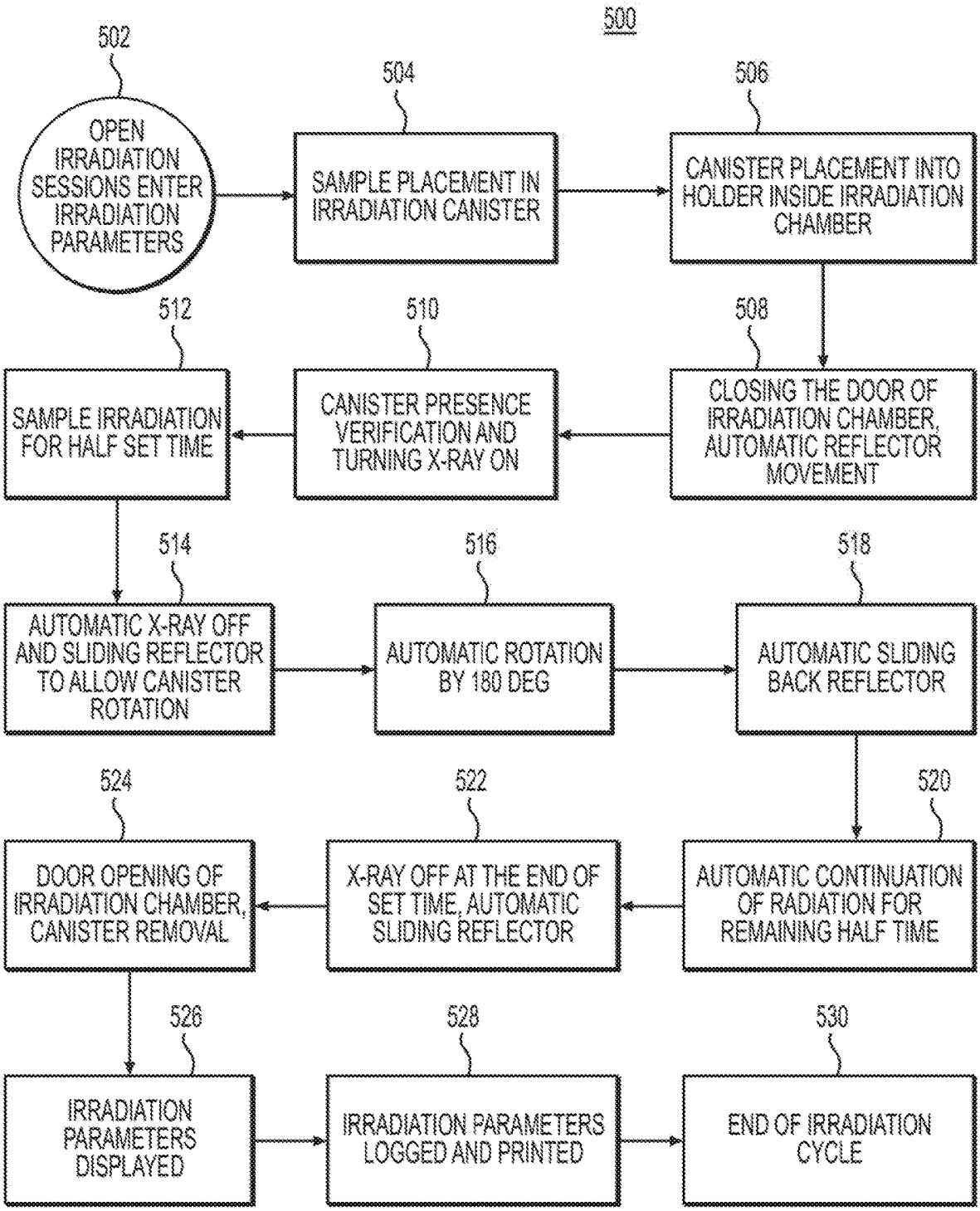

FIG. 1E4 and FIG. 1E5 further illustrate that, depending on the use or application, the product sample canister or container 2*a* including the product sample 2, can be rotated or oriented in other axes or orientations, such as with reference to the X, Y and Z coordinate axis system, so as to be positioned or oriented in other suitable positions or orientations within the X, Y and Z coordinate axis system for radiation delivery. For example, FIG. 1E4 illustrates the product sample canister or container 2*a* including the product sample 2*a* being rotated or oriented with respect to the Y axis to another orientation or position for radiation delivery and the radiation being delivered to the product sample 2 in the another orientation or position, such as illustrated in FIG. 1E5, for example.

As is evident from FIGS. 1E1-1E5, in embodiments of the irradiator apparatus or system, such as irradiator apparatus or system 100, and in embodiments of methods of product sample irradiation, the product sample 2 can be irradiated after being rotated or oriented to any of various suitable positions or orientations for radiation delivery, such as various suitable rotations or orientations in reference to the X, Y and Z coordinate axis system by same or similar suitable mechanisms to those described, as can depend on the use or application, and should not be construed in a limiting sense. It is however desirable to rotate or orient the product sample canister or container 2*a* including the product sample 2 in or about the Z axis direction, with reference to the X, Y and Z coordinate axis system, which can facilitate a relatively more uniform dose distribution throughout the volume of the product sample 2, for example.

Figure 2A:
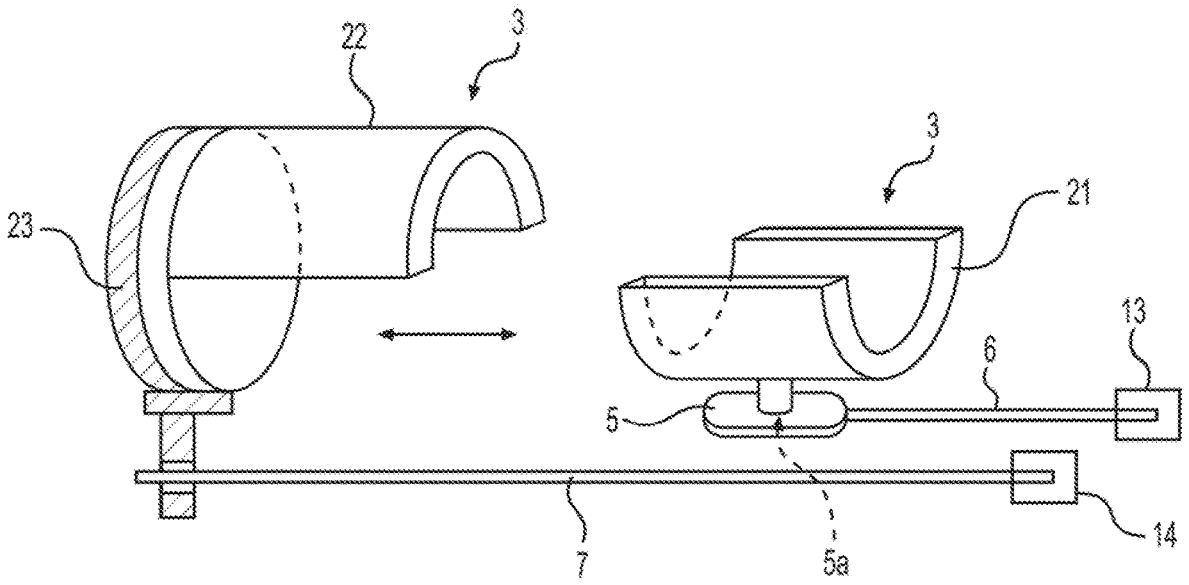
FIG. 2A is a schematic illustration of an embodiment of a multi-part reflector assembly of an irradiator apparatus or system illustrating reflector assembly components of a reflector assembly having a first part configured to provide or be integrated or associated with a sample holder for a product sample container or canister configured to include a product sample to be the irradiated in communication with a rotation device to selectively rotate or orient the product sample to corresponding ones of a plurality of positions or orientations, and the reflector assembly having a second part configured for selective free linear movement towards or away from the product sample, such as by using a motor, to enable and facilitate rotation of the product sample container or canister including the product sample to position or orient the product sample in a plurality of positions or orientations for radiation delivery, according to the present invention.

FIG. 2A provides an expanded view of a desirable embodiment of the reflector assembly 3 in embodiments of the irradiator apparatus or system 100. FIG. 2A shows the reflector assembly 3 formed in two parts, with a first part, a cradle 21, attached to a turntable assembly forming the sample holder 5, and a second part, a mobile reflector 22, of the reflector assembly 3 is sliding laterally away from or toward the cradle 21 using the shaft assembly 7, controlled by the motor 14 in a linear motion, to allow rotation or orientation of the product sample 2. Shaft assembly 7 can desirably have screw indents and slides precisely and desirably using the stepper motor 14 and suitable bearings as known in the art on a linear guide, with a limit switch detect to ensure that the right distance of opening and closing is achieved or facilitated for the second part mobile reflector 22.

The reflector assembly 3 can include a metal holder 23 that attaches to the mobile reflector 22 and to a moving bearing of the shaft assembly 7 to ensure substantially full movement of the mobile reflector 22. Mobile reflector 22 when closed with the cradle 21 constitutes a closed hollow cylinder cover with walls having a suitable thickness, such as a one inch thickness or more, for example, to provide a relatively effective reflector assembly 3. The cradle 21 is rotated or oriented, such as by using a bearing mounted to the rotation device 5*a* driven by shaft assembly 6 and the motor 13. The rotation device 5*a* desirably can be a worm gear and worm. However, spur gears, miter gears, bevel gears, a chain and sprocket or direct drive could be used for or included in the rotation device 5*a*, for example, as can depend on the use or application, and should not be construed in a limiting sense.

Figure 2B:
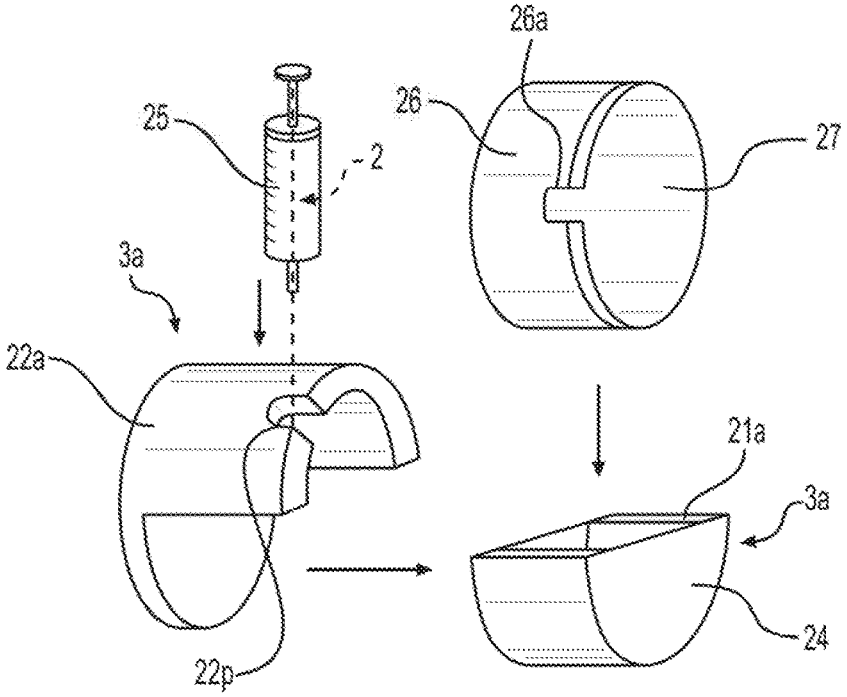
FIG. 2B is a schematic illustration of an embodiment of a multi-part reflector assembly of an irradiator apparatus or system illustrating reflector assembly components of a reflector assembly having a first part configured to provide or be integrated or associated with a sample holder for a product sample container or canister configured to include a product sample, and the reflector assembly having a second part including an aperture located in the second part reflector assembly wall to receive and support product samples in product sample containers of a suitable configuration, such as of a of cylindrical profile or configuration, as can receive syringes, and the second part of the reflector assembly being configured for selective free linear movement towards or away from the product sample containers or canisters, such as the product sample containers or canisters with latched lids to be positioned in association with the first part of the reflector assembly, to enable and facilitate rotation of the product sample container or canister including the product sample to position or orient the product sample in a plurality of positions or orientations for radiation delivery, according to the present invention.

FIG. 2B illustrates an embodiment of a reflector assembly 3*a* having the cradle 21*a* including cradle sides 24 each respectively attached on both sides of the cradle 21*a* to maintain a product sample canister or container 26 that receives or includes the product sample 2 in position during rotation or orientation of the sample holder 5 to position the product sample 2 in one or more positions for radiation delivery, as described. The cradle sides 24 are desirably made of thin materials (of a 1 mm thickness, for example), such as polystyrene or acrylic (Polymethyl methacrylate, PMMA), or fiberglass to allow sturdiness while having a lower X-ray absorption. The product sample canister or container 26 desirably includes an aperture 26*a* of a generally U-Shaped configuration, which generally U-Shaped configuration can extend into a lid 27 of the product sample canister or container 26. The aperture 26*a* is configured to receive a cylindrical shaped product sample container 25, such as a can be a syringe full of blood or blood products as the product sample 2, for irradiation by the irradiator apparatus or system 100.

Continuing with reference to FIG. 2B, the product sample canister or container 26 can also have other types of product samples 2 placed inside the product sample canister or container 26, such as by removing the lid to place the product sample 2 in the product sample container or canister 26 and then reinstalling the lid 27 after the product sample 2 is placed inside the product sample canister or container 26, and then placing the product sample canister or container 26 with the sample holder 5, for example. Also, the mobile reflector 22*a* of the reflector assembly 3*a* can have a corresponding aperture 22*p* that aligns with the aperture 26*a* when the mobile reflector 22*a* is moved to a position aligned with the cradle 21*a*. The arrows in FIG. 2B illustrating exemplary directions of movement of the various components of the reflector assembly 3*a*, the product sample canister or container 26, and the cylindrical shaped product sample container 25 when assembled for radiation delivery, for example.

Also, it is desirable for the product sample canister or container 26 and the lid 27 to be secured to each other with a suitable locking mechanism or latches to keep product samples 2 in place during rotation or orientation of the product sample canister or container 26. Also, the product sample canister or container 26 can, in addition to having a generally cylindrical shape or configuration, can also have an oval or ellipsoidal shape or configuration, or other suitable configuration, and such latches can be designed to fit, for example, in a disc shape, to allow or facilitate relatively easy sliding of the product sample canister or container 26 into the cradle 21*a* and to be surrounded by the mobile reflector 22*a* of reflector assembly 3*a*. The product sample canister or container 26 can hold liquid specimens or bags of liquids such as blood products, or live laboratory animals such as mice, or biological samples such as tissue or bone, etc. as the product sample 2, for example. Also, what constitutes the product sample 2 can be any of various suitable product samples, as can be various materials, liquids, objects, compositions, organisms, etc., as can depend on the use or application, and should not be construed in a limiting sense. One application, among others, is use of embodiments of irradiator apparatus and systems, such as the irradiator apparatus or system 100, to irradiate blood for the prevention of Transfusion Associated Graft-Versus-Host Disease (TA-GvHD), for example.

Figure 2C:
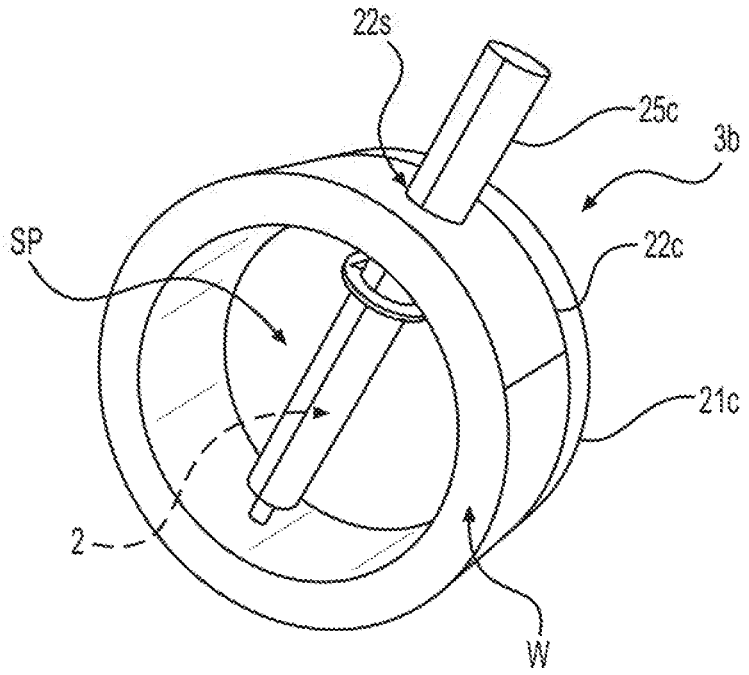
FIG. 2C is an embodiment of a schematic illustration of a reflector assembly having an aperture located in the reflector assembly wall to receive and support product sample containers of a suitable configuration to position a product sample therein in a sample receiving space formed within the reflector assembly, the aperture being of a suitable configuration, such as a cylindrical shape or configuration as can receive syringes, to be positioned or placed in the aperture in the reflector assembly wall, and the product sample supported or positioned in the reflector assembly can selectively be rotated or oriented to a plurality of positions or orientations or can remain in a single predetermined stationary position for irradiation of the product sample, according to the present invention.

FIG. 2C is an embodiment of a schematic illustration of a reflector assembly 3*b* having a first reflector portion 21*c* that engages with a second reflector portion 22*c* to form the reflector assembly 3*b*, the second reflector portion 22*c* can be configured to be movable, such as described for the movable reflector 22. The second reflector portion 22*c* includes a generally cylindrical, or other suitable shaped, aperture 22*s*, such as can be formed by drilling, located in the reflector assembly wall W of the second reflector portion 22*c* to receive and support a product sample container 25*c*, such as a syringe like or a syringe product sample container 25*c*, of a suitable configuration to position a product sample 2 therein in a sample receiving space SP formed within the reflector assembly 3*b*.

In FIG. 2C, the product sample 2 in the product sample container 25*c* is supported or positioned in the reflector assembly 3*b* and can selectively be rotated or oriented to a plurality of positions or orientations, as described, or can remain in a single predetermined stationary position for irradiation of the product sample 2, such as can be desirable for smaller product sample volumes, such as a blood sample as the product sample 2 placed in a syringe as the product sample container 25*c*, where rotation of the product sample 2 may not be needed, but could be desirable, when irradiating the product sample 2 by the irradiator system or apparatus 100, for example.

Figure 2D:
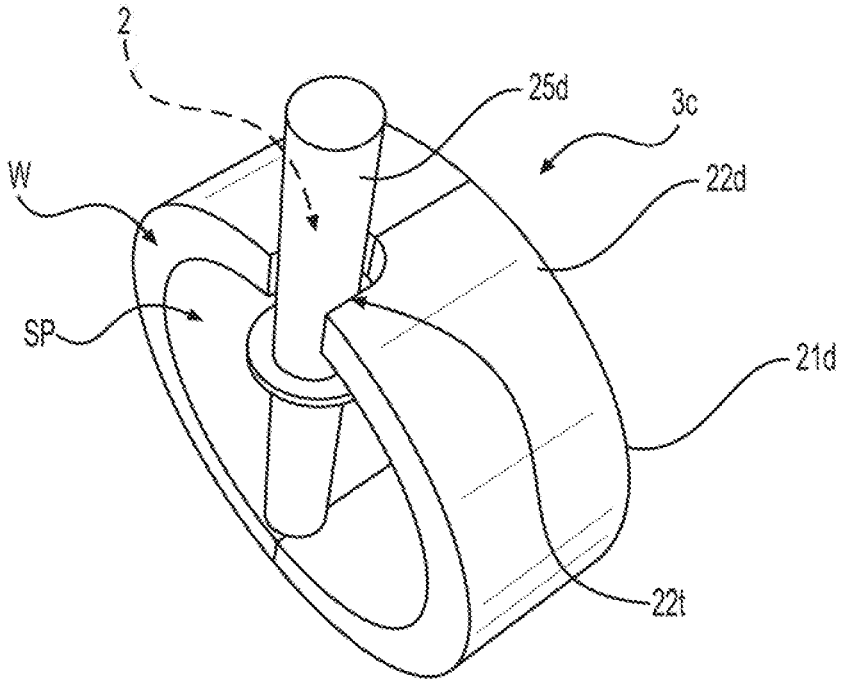
FIG. 2D is an embodiment of a schematic illustration of a reflector assembly having a U-shaped notch located in the reflector assembly wall to receive and support product sample containers of a suitable configuration to position a product sample therein in a sample receiving space formed within the reflector assembly, the aperture being of a suitable U-shaped configuration, such as can receive syringes, to be positioned or placed in the aperture in the reflector assembly wall, and the product sample supported or positioned in the reflector assembly can selectively be rotated or oriented to a plurality of positions or orientations or can remain in a single predetermined stationary position for irradiation of the product sample, according to the present invention.

FIG. 2D is an embodiment of a schematic illustration of a reflector assembly 3*c* having a first reflector portion 21*d* that engages with a second reflector portion 22*d* to form the reflector assembly 3*c*, the second reflector portion 22*d* can be configured to be movable, such as described for the movable reflector 22. The second reflector portion 22*d* includes a generally U-shaped notch, or other suitable open side shaped, aperture 22*t*, such as can be formed by drilling, located in the reflector assembly wall W of the second reflector portion 22*d* to receive and support product sample containers 25*d*, such as of a generally tubular or cylindrical shape, of a suitable configuration, as can include various syringes to position a product sample 2 therein in a sample receiving space SP formed within the reflector assembly 3*c*, for example.

In FIG. 2D, the product sample 2 in the product sample container 25*d* is supported or positioned in the reflector assembly 3*c* and can selectively be rotated or oriented to a plurality of positions or orientations, as described, or can remain in a single predetermined stationary position for irradiation of the product sample 2, such as can be desirable for smaller product sample volumes, such as a blood sample as the product sample 2 placed in a syringe as the product sample container 25*d*, where rotation of the product sample 2 may not be needed, but could be desirable, when irradiating the product sample 2 by the irradiator system or apparatus 100, for example.

The material used for reflector assemblies 3, 3*a*, 3*b* and 3*c* can be formed of any of various suitable materials, desirably a sintered graphite, manufactured as cylindrical rods, and machined for various desirable shapes or configurations, such as those described in FIGS. 2A-2D. Other suitable materials, such as disclosed in U.S. Pat. No. 6,389,099B1 incorporated by reference herein in its entirety, of a low or relatively low Z atomic number and a high density such as boron carbide, boron and carbon, as well as a diamond form of carbon, and combinations thereof, for example, can be used to machine or form the reflector assembly, such as the reflector assemblies 3, 3*a*, 3*b* and 3*c*. Other desirable features of the material surface of the reflector assembly, such as the reflector assemblies 3, 3*a*, 3*b* and 3*c*, are a good lateral homogeneity in density, to facilitate optimal X-ray reflection for the irradiation.

In the irradiator apparatus or system 100, unwanted and residual radiation scattering from the irradiated material and reflector assembly, such as the reflector assemblies 3, 3*a*, 3*b* and 3*c*, can be substantially stopped and absorbed using lead protective sheets or shielding in surrounding relation to the irradiator apparatus or system 100, appropriate to the X-ray energy used. Desirably, the shielding material typically has a 1 inch range thickness or other suitable range of thickness, and is attached to the X-ray irradiator apparatus or system outer walls or in the reflector assembly vicinity, or both, and such shielding can facilitate providing protection from radiation to users of the irradiator apparatus or system, such as the irradiator apparatus or system. 100. Also, the irradiator apparatus or system design, such as described herein in relation to the irradiator apparatus or system 100, facilitates providing a self-contained compact irradiator design, construction and configuration, such an in comparison to a two X-ray source irradiator, for example.

Figure 3A:
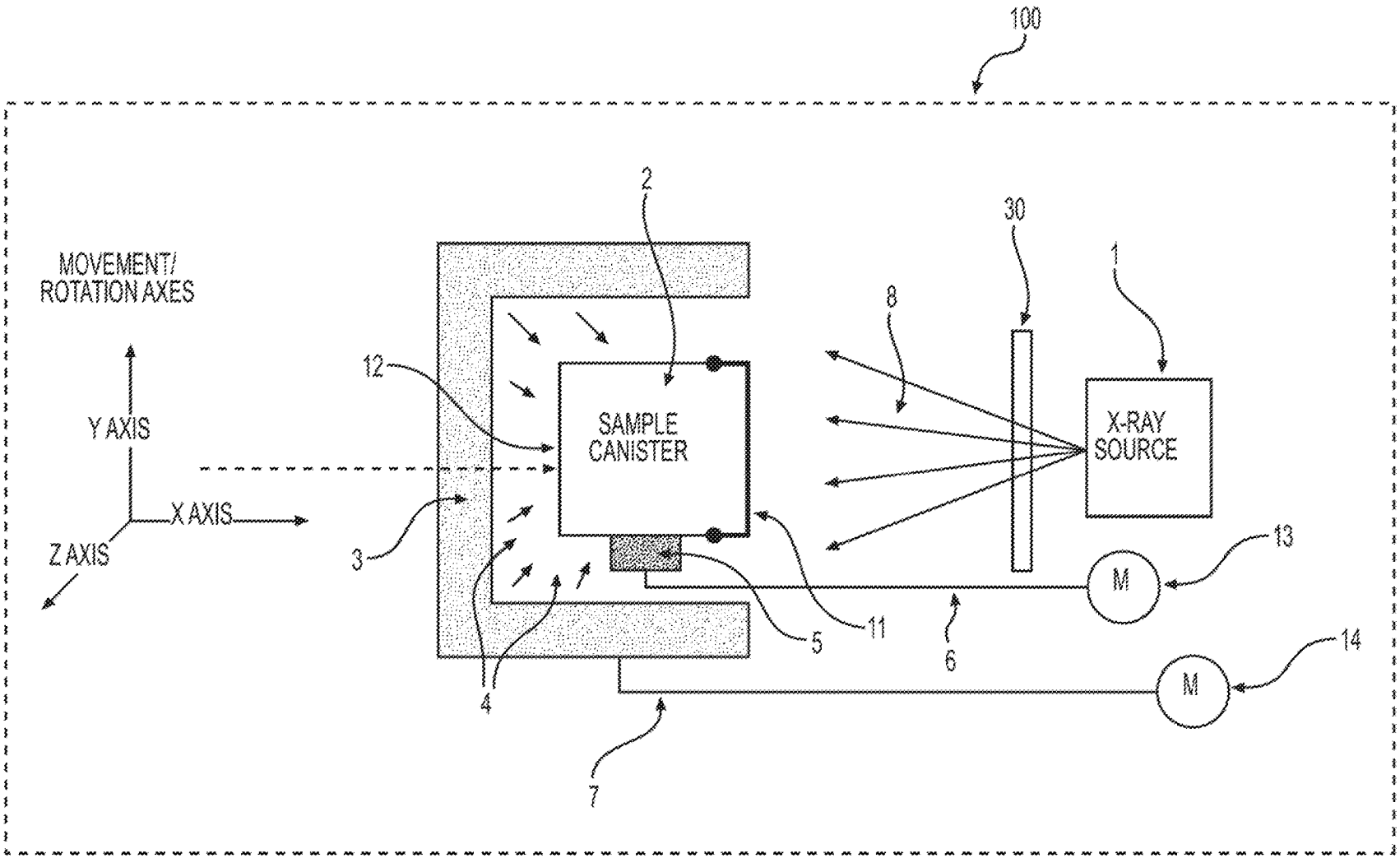
FIG. 3A is a schematic, perspective top view illustration of an embodiment of an X-ray filter of embodiments of an irradiator apparatus or system illustrating the X-ray filter having a flat filter shape, profile or configuration, according to the present invention.

FIG. 3A shows a schematic illustration of an embodiment of the irradiator apparatus or system 100 which includes an X-ray filter 30 made of a suitable material or a suitable configuration, such as of a copper sheet, to filter radiation generated by the radiation source, such as low energy X-rays of the 160 keV spectrum obtained using an X-ray tube powered at 160 kVp, for example, kVp referring to the maximum output (peak voltage) of the X-ray tube. For example, the x-rays produced by a 160 kVp tube can typically have energies of 160 keV and lower. Filtration of the generated radiation is considered important, such as for low-energy X-rays, as the low energy X-rays typically do not penetrate relatively deep inside the irradiated sample 2, as well as the low energy X-rays can create inhomogeneous dose distribution at penetration depth. Desirably, the filter 30 is a copper filter 30 having a configuration of a flat sheet, desirably 75 microns to 130 microns (3 to 5 thousandth of an inch) thickness to facilitate achieving an effective X-ray beam 8 filtration and good depth penetration (up to few cm) in irradiated product sample 2. Also the filter 30 can be on any of various suitable materials, such as copper or aluminum, and of various suitable shapes, profiles and configurations, as can depend on the use and application, and should not be construed in a limiting sense. For example, different metals can be used for the filter depending upon different portions of the x-ray or radiation spectrum desired to be blocked by the filter.

Figure 3B:
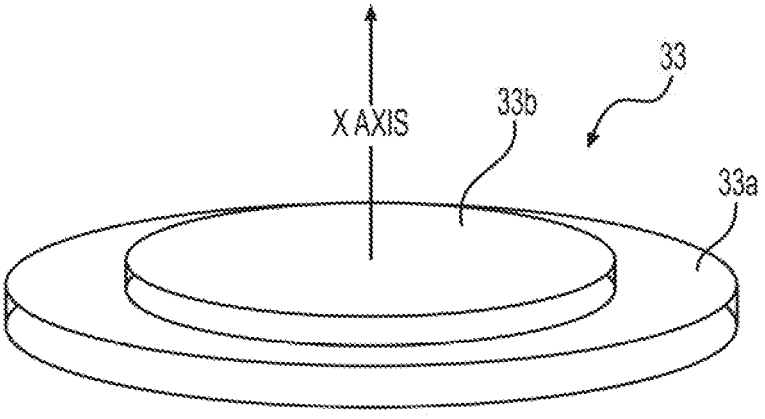
FIG. 3B is a schematic illustration of an embodiment of an X-ray filter of embodiments of an irradiator apparatus or system illustrating the X-ray filter desirably having a step-filter shape, profile or configuration, according to the present invention.

FIG. 3B is a schematic illustration of an embodiment of an X-ray filter 33 of embodiments of an irradiator apparatus or system 100 illustrating the X-ray filter 33 desirably having a step-filter shape, profile or configuration. In a desirable embodiment of the filter 33 of FIG. 3B, the filter 33 takes a shape of a step-filter 33, which includes, for example, two attached filters 33*a* and 33*b* of different surface sizes and thicknesses, a top filter 33*b* of the filter 33 being of smaller surface dimensions or area than a surface or dimensions of the bottom filter 33*a* of the filter 33.

Figure 3C:
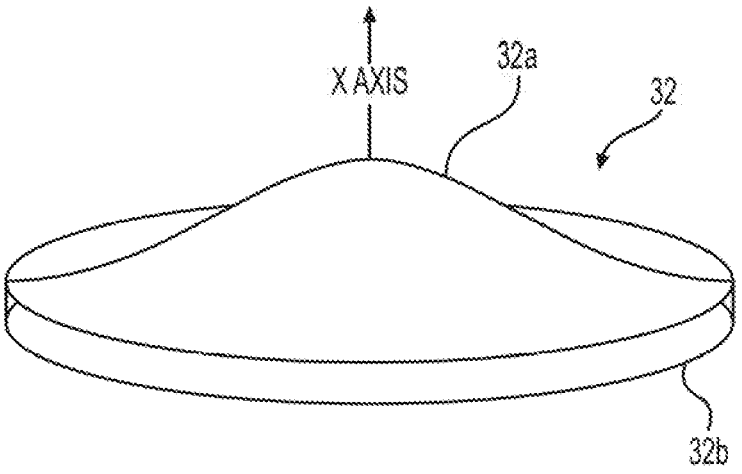
FIG. 3C is a schematic illustration of an embodiment of an X-ray filter of embodiments of an irradiator apparatus or system illustrating the X-ray filter having a bell-filter shape, profile or configuration, according to the present invention.

Also, FIG. 3C is a schematic illustration of an embodiment of an X-ray filter 32 of embodiments of an irradiator apparatus or system 100 illustrating the X-ray filter 32 having a bell-filter shape, profile or configuration. In the embodiment of the filter 32 in an embodiment of FIG. 3C, the filter 32 takes a shape, configuration or profile of a gradient distribution, which includes, for example, a base filter portion 32*b* and a gradient filter portion 32*a* extending from the base filter portion 32*b*.

In embodiments of filters, such as the filter 33 of FIG. 3B and the filter 32 of FIG. 3C, several combination of filter thicknesses can be obtained from 75 microns to 130 microns from the edges to the center of the filter, either in a gradient distribution, such as the filter 32 in FIG. 3C, or in a step configuration, such as the desired embodiment of the filter 33 in FIG. 3B. Also, a filter set-up in a step-shape configuration, such as the filter 33 in FIG. 3B, can allow a selective spatial filtration of the X-ray beam 8 so as to desirably facilitate providing a relatively important attenuation at the beam 8 center and less attenuation at the edges of the beam 8. Also, in this regard, for example, a step filter, such as the filter 33, can include a 50 micron or a 130 micron thick copper disk, having a 3 cm in radius, centered on the x-ray beam 8, forming the top filter 33*b* surrounded by a ring of 80 micron thick copper forming the bottom filter 33*a*, such as by being bonded to each other, for example. Also, chemical etching or sputtering processes with suitable masking can also be desirably used on a single sheet of suitable material, such as of copper or aluminum, in forming the step shape of the step filter, such as the filter 33, for example.

In embodiments of filters, such as the filters 30, 32 and 33, for use with irradiator apparatus and systems, such as the irradiator apparatus and system 100, various other suitable combinations of filter thicknesses, such as typically up to 400 microns, can provide a relatively practical beam filtration, as well as can facilitate providing desirable dose rates and desirable dose distributions throughout the product sample, such as the product sample 2. Various suitable materials, such as copper or aluminum, and various suitable compositions, thicknesses, shapes, configurations and profiles for embodiments of radiation filters can be used, as can depend on the use or application, and should not be construed n a limiting sense.

FIG. 4A is a graphic illustration of an exemplary lateral dose profile of irradiation in a plastic block, as the product sample 2, delivered using an embodiment of an irradiator apparatus or system, such as the irradiator apparatus or system 100, having a single X-ray tube and an X-ray filter of a flat filter shape, profile or configuration similar to the filter 30 of FIG. 3A. The graph in FIG. 4A illustrates a dose higher at a center of the irradiated plastic block and dose lower at edges of the irradiated plastic block using a single X-ray tube with a flat 80 micron (3/1000 inch thick) copper filter, similar to the filter 30. The x-axis in the graph of FIG. 4A represents a position along the product sample canister or container 2*a* including the product sample 2 (the plastic block) from one side to the other, with the "0" position on the X axis being the center of the product sample canister or container 2*a*, and the y axis in the graph of FIG. 4A represents a relative amount of dose being delivered at each measurement point relative to what is delivered to the product sample 2 (the plastic block) at the center of the product sample canister or container 2*a* (i.e., it is a normalized representation).

FIG. 4B is a graphic illustration of a theoretical lateral dose profile of irradiation in a plastic block as delivered using an embodiment of an irradiator apparatus or system, such as the irradiator apparatus or system 100, as having a single X-ray tube and an X-ray filter of a step-filter shape, profile or configuration, similar to the filter 33 of FIG. 3B. The theoretical representation of the radiation dose in the graph of FIG. 4B illustrates relatively improved dose uniformity over that using an X-ray filter of a flat filter shape, profile or configuration, such as the filter 30, having a dose at the center attenuated so as to provide a relatively good substantial uniformity of the dose throughout the lateral direction of the plastic block product sample, according to the present invention.

In FIG. 4B, the use of the step-filter 33 can result in a better dose uniformity at the same depth of the irradiated sample 2. Indeed the ratio of the minimum dose to the center dose is improved from a ratio of 1.34 to a ratio of 1.19. The 130 micron copper filter 33 can allow targeted beam attenuation at the desired beam profile zone (central zone) while the 80 micron copper step can allow beam transmission with less attenuation at the beam edges.

The x-axis in the graph of FIG. 4B represents a position along the product sample canister or container 2*a* including the product sample 2 (the plastic block) from one side to the other, with the "0" position on the X axis being the center of the product sample canister or container 2*a*. The y axis in the graph of FIG. 4B represents a relative amount of dose being delivered at each measurement point relative to what is delivered to the product sample 2 (the plastic block) at the center of the product sample canister or container 2*a* for the flat filter configuration (i.e., it is a normalized representation). In this regard, the dose uniformity within irradiated samples of blood or bone marrow is typically considered very critical for the activation or treatment of a blood or a bone marrow specimen, as a product sample to be treated, which specimen can show relatively strong sensitivity starting at defined radiation dose thresholds for which use of a filter, such as the step filter 33, in an irradiator apparatus or system, such as the irradiator apparatus or system 100, can be beneficial.

Also, the filter 33 could be manufactured using two thin sheets of copper of different areas and thicknesses that can be bonded each other using glue (bonding polymers or metallic glue, etc.). For example a step filter, such as the step filter 33, can be formed of a 50 micron (1/1000 inch) thick copper disk, 3 cm in radius, centered on the x-ray beam, bonded to a full sheet of 80 micron (3/1000 inch) thick copper, with the center of the filter being a 5/1000 inch thick sheet of copper with the edges of the filter remaining a 3/1000 inch thick sheet of copper, for example. Also, for relatively precise filter manufacturing of the step filter, various processes can be used in forming the step shape filter, such as chemical etching or sputtering with proper masking can be desirable using a single sheet of material such as copper, to achieve the step shape of the filter, for example. Also, as described, other suitable materials, such as Aluminum, Tungsten, and other metals, for example, can be used optimally in single or combined material sheets in forming the filter, such as the step shape filter 33, to shape the radiation beam to facilitate creating an optimal or desirable lateral beam distribution, such as that shown in the graph of FIG. 4B, for example.

Figure 6:
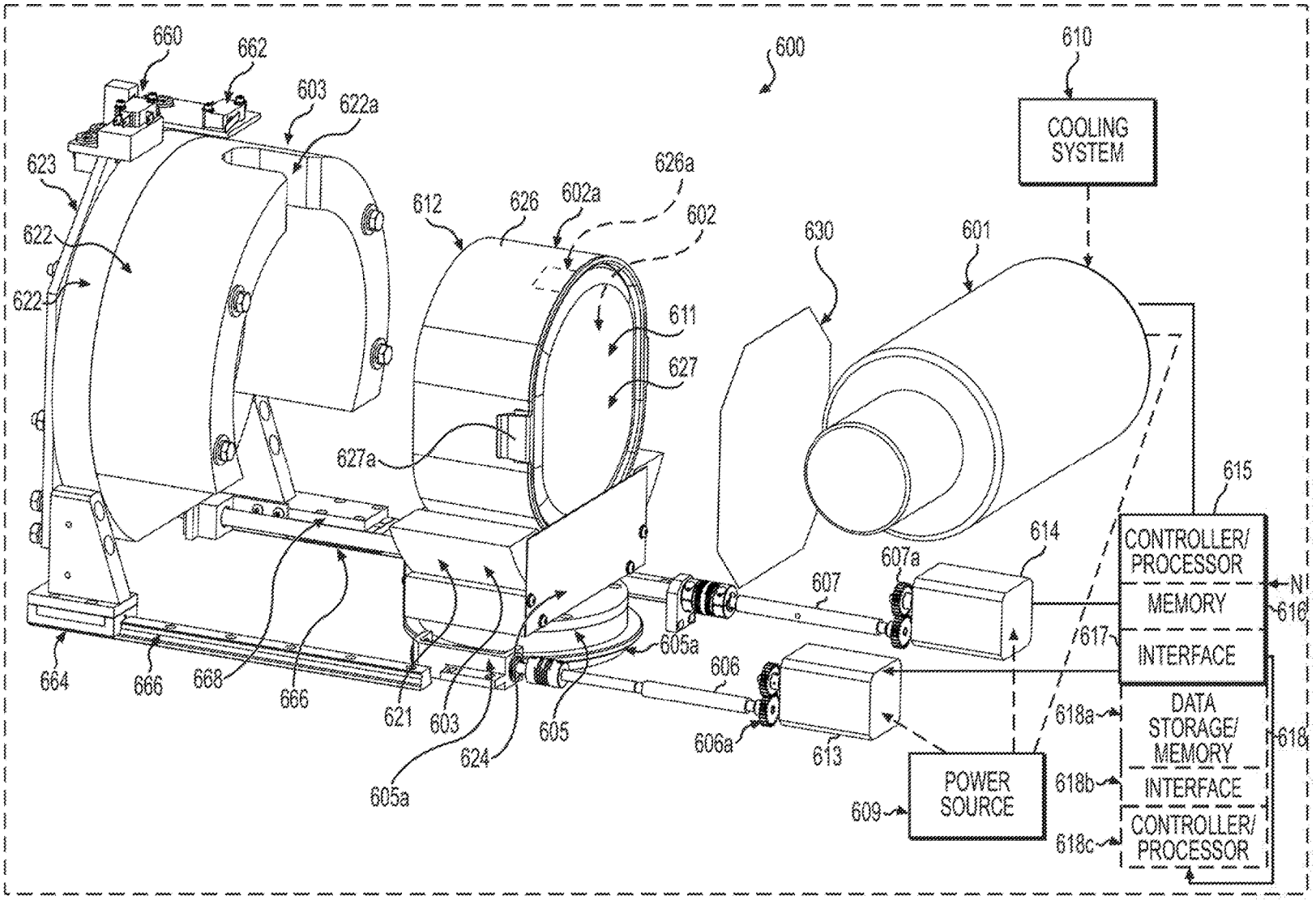
FIG. 6 is a perspective, exploded view of an embodiment of an irradiator apparatus or system of embodiments of the irradiator apparatus and system of FIGS. 1A-1D illustrating a relatively compact system design, according to the present invention.

Before discussing embodiments of an exemplary process flow diagram of methods for irradiation a product sample of FIG. 5, continuing, FIG. 6 is a perspective, exploded view of an embodiment of an irradiator apparatus or system 600 of embodiments of the irradiator apparatus and system 100 of FIGS. 1A-1D illustrating a relatively compact irradiator apparatus or system design.

FIG. 6 illustrates a perspective exploded view of an exemplary construction of an embodiment of the irradiator apparatus or system 600 and its various components that are similar to apparatus and components described with reference to the irradiator apparatus or system 100, such as apparatus and components illustrated and described in relation to FIGS. 1A-1D, 2A-2D and 3A-3C. In the embodiment of the schematic illustration of an irradiator apparatus or system 600 of FIG. 6, there is included a single radiation source 601, such as an X-ray tube 601, and a radiation filter 630, such as an X-ray filter 630, positioned in facing relation to a product sample 602 to be irradiated, such as positioned in a product sample canister or product sample container 602*a*, illustrated as being positioned within a moveable reflector or reflector assembly 603. A suitable cooling system 610 is in communication with the single radiation source 601 to cool the single radiation source 601 for radiation delivery, with a suitable power source 609 being in communication with the single radiation source 601 and other components of the irradiation apparatus or system 600 to provide operating power to the single radiation source 601 for radiation delivery and to operate other components of the irradiator apparatus or system 600.

In FIG. 6, the power source 609, for example, powers a suitable motor 614 for movement of at least a part of the reflector assembly 603, the motor 614 being in communication with a suitable driver, such as a suitable shaft assembly 607 to drive movement of at least a part of the reflector assembly 603, such as toward or away from product sample container or canister 602*a* that includes the product sample 602. Also, for example, the power source 609 desirably provides power to a suitable motor 613 that is communicatively connected to or associated with a sample holder 605, such as through a shaft assembly 606, communicatively associated with a rotation device 605*a* to rotate, flip or orient the product sample canister or container 602*a* and the product sample 602 to a plurality of positions or orientations to deliver radiation to the product sample 602 selectively positioned at corresponding ones of the plurality of positions or orientations to facilitate a substantially uniform irradiation of the product sample 602 and a substantially uniform radiation exposure delivered to the product sample 602 to provide a substantial dose profile uniformity in the irradiated product sample 602. Also, a shielding material is desirably added to the irradiator apparatus or system 600 walls, outwardly, in a self-contained configuration to shield against radiation leakage and exposure to users of the irradiator apparatus or system 600, and a sliding door or other suitable removable cover facilitating access to and removal from the irradiator apparatus or system 600 the product sample canister or container 602*a* or the product sample 602 is also typically provided for the irradiator apparatus or system 600.

In FIG. 6, the X-ray tube 601 is facing a front side 611 of the product sample canister or container 602*a* and the product sample 602 to deliver radiation to the product sample 602 through the front side 611 to irradiate the product sample 602, the radiation passing though the radiation filter 630, such as the X-ray filter 30, 32, 33. The reflector assembly 603 reflects X-rays, or other suitable radiation, that has been provided in a radiation beam, such as the previously described beam 8, delivered by the single radiation source 601, that has been filtered by the radiation filter 630, such as the X-ray filter 30, 32, 33, and provided to the product sample 602 through its front side 611, for example, back to the product sample 602. The sample holder 605 associated with the reflector assembly 603 is configured to hold the product sample canister or container 602*a* that receives the product sample 602 to be irradiated. The X-ray beam, such as the beam 8, is partly absorbed by product sample 602 at the front side 611 and the remaining delivered radiation is partly scattered and reaches the reflector assembly 603 which results in a reflected X-ray beam, such as the previously described reflected X-ray beam 4, being delivered to the product sample 602 from a rear side 612 of the product sample canister or container 602*a* that includes the product sample 602.

After a first of a plurality of irradiations of the product sample 2, such as illustrated in FIG. 1B, at a first position or orientation, such as a position or orientation having the front side 611 of the product sample canister or container 602*a* including the product sample 602 being positioned in facing relation to the single radiation source 601, it is desirable to rotate the product sample container 602*a* including the product sample 602 to other of a plurality of positions or orientations for radiation delivery to the product sample 602. In this regard, the rotation device 605*a*, such as a worm gear and worm arrangement, is associated with the sample holder 605 and configured to selectively rotate, flip or orient the product sample canister or container 602*a* and the product sample 602 to a plurality of positions or orientations to deliver radiation to the product sample 602 positioned at each of the plurality of positions or orientations to facilitate a substantially uniform irradiation of the product sample 602 and a substantially uniform radiation exposure delivered to the product sample 602 providing a substantial dose profile uniformity in the irradiated product sample 602.

FIG. 6, similar to FIG. 1C, illustrates the irradiator apparatus or system 600 having the product sample 602 in the product sample canister or container 602*a* being positioned outside of the reflector assembly 603 to enable the product sample 602 in the product sample canister or container 602*a* to be positioned or oriented an another one of a plurality of positions or orientations for irradiation of the product sample 602. Similar to the description and illustration of FIG. 1C, the product sample 602 and the product sample canister or container 602*a* can similarly be rotated by one hundred eighty (180) degrees by the rotation device 605*a* associated with the sample holder 605 from the front side 611 position of the product sample canister or container 602*a* including the product sample 602 to the rear side 612 of the product sample canister or container 602*a* including the product sample 602. The rotation device 605*a* in embodiments of the irradiator apparatus or system 600 can be configured with the reflector assembly 603 to flip, orient or rotate the product sample canister or container 602*a* to facilitate delivery of radiation to the product sample 602 at different positions or orientations of the rotatable product sample canister or container 602*a*.

Similar to that described in relation to FIG. 1C, the sample holder 605 to position or orient the product sample canister or container 602*a* including the product sample 602 for delivery of radiation is rotated or oriented by the rotation device 605*a*. The rotation device 605*a* is associated with the shaft assembly 606 and a gear arrangement 606*a* and the rotation or orientation movement of the rotation device 605*a* is powered by the motor 613, such as desirably a stepper motor 613, the motor 613 driving the gear arrangement 606*a* in communication with the shaft assembly 606 to drive the rotation device 605*a* to rotate the sample holder 605 to then rotate the product sample canister or container 602*a* including the product sample 602 one hundred eighty (180) degrees so that the rear side 612 of product sample container 602*a* including the product sample 602 is now positioned in facing relation to the single radiation source 601 and the generated radiation beam, such as the radiation beam 8, generated by the single radiation source 601, for example. Similar to that described in FIG. 1C, to enable rotation of the product sample container 602*a* including the product sample 602, the reflector assembly 603 is moved by a shaft assembly 607 powered by the motor 614, such as using a stepper motor 614, the shaft assembly 607 communicating with a gear arrangement 607*a* that communicates with the motor 614 to move at least a second part or portion 622 of the reflector assembly 603 away from a first part or portion 621 of the reflector assembly 603 that is in communication with the product sample canister or container 602*a* including the product sample 602 and, therefore, moved away from the product sample canister or container 602*a* including the product sample 602. Moving at least the second part or portion 622 of the reflector assembly 603 away from the product sample canister or container 602*a* including the product sample 602 provides a space or area within the irradiator apparatus or system 600 to enable the rotation device 605*a* associated with the sample holder 605 that holds or supports the product sample canister or container 602*a* or the product sample 602, to rotate, flip or orient the product sample container 602*a* and the product sample 602 to another of a plurality of radiation delivery positions or orientations, such as to rotate the product sample 602 by one hundred eighty (180) degrees in this case, such that the rear side 612 of the product sample canister or container 602*a* and the product sample 602 is positioned in facing relation to the single radiation source 601 for radiation delivery at this another of a plurality of radiation delivery positions or orientations. The shaft assembly 607 is communicatively associated with a lead screw arrangement 668 that is associated with a linear rail carriage 664 to selectively move the linear rail carriage 664 on an opposing pair of linear rails 666 to selectively move the second part or portion 622 of the reflector assembly 603 to and from engaging relation with the first part or portion 621 of the reflector assembly 603 to selectively cover or expose the product sample canister or container 602*a* and the product sample 602, for example.

Also, it is desirable that the described motor movement of the reflector assembly 603 through the shaft assembly 607 by the motor 614 and the described motor movement of the rotation device 605*a* associated with the sample holder 605 though the shaft assembly 606 by the motor 613 be implemented in an automated system of the Network N, such as under control of a controller/processor 615, or other suitable automated control, for example, as such automated control can enhance the radiation throughput delivered to the product sample 602. However, manual movement of the rotation device 605*a* associated with the sample holder 605 though the shaft assembly 606 and manual movement of the second part or portion 622 of the reflector assembly 603 through the shaft assembly 607 can also be performed, either with or without the use of the motors 613 and 614, as can be desirable for certain uses or applications, and, therefore, the manner of movement of the reflector assembly 603 and the rotation device 605*a* associated with the sample holder 605 should not be construed in a limiting sense.

Similar to that described with reference to FIG. 1D, the product sample 602, after being rotated, such as described, then is irradiated by radiation from the X-ray-tube 601, with the product sample canister or container 602*a* including the product sample 602 positioned inside the reflector assembly 603 and the back or rear side 612 of the product sample canister or container 602*a* including the product sample 602 positioned in facing relation to the radiation source 601 for radiation delivery to the product sample 602 through the back or rear side 612. Prior to radiation delivery by the single radiation source 601 at the radiation delivery position or orientation having the back or rear side 612 of the product sample canister or container 602*a* including the product sample 602 positioned in facing relation to the single radiation source 601, the reflector assembly 603 is returned to the radiation delivery position, such as illustrated in FIG. 1D, the reflector assembly 603 covering or being positioned in surrounding relation to the fully rotated product sample canister or container 602*a* including the product sample 602.

The radiation beam generated by the single radiation source 601, such as the X-ray beam 8, is applied to the product sample 602 from the back or rear side 612 allowing back irradiation of the product sample 602. The X-ray tube 601 is now facing the back or rear side 612 of the product sample canister or container 602*a* and the product sample 602 to deliver radiation to the product sample 602 to irradiate the product sample 602, the radiation passing though the radiation filter 630, such as the X-ray filter 30, 32, 33. The reflector assembly 603 reflects X-rays providing the radiation in the beam, such as the X-ray beam 8, delivered by the single radiation source 601, filtered by the radiation filter 630, such as the X-ray filter 30, 32, 33, to the product sample 602 back to the product sample 602. The sample holder 605 associated with the reflector assembly 603 is configured to hold the product sample canister or container 602*a* that receives the product sample 602 to be irradiated and the product sample 602.

In the irradiation of the product sample 602 in a second radiation delivery position or orientation, such as illustrated in FIG. 1D, the X-ray beam, such as the X-ray beam 8, is partly absorbed by the product sample 602 at the back or rear side 612 and the remaining delivered radiation is partly scattered and reaches the reflector assembly 603 which results in a reflected X-ray beam, such as the X-ray beam 4, being delivered to the product sample 602 in a direction toward the front side 611 of the product sample canister or container 602*a* and the product sample 602, in that the product sample canister or container 602*a* and the product sample 602 has been rotated or oriented from the initial or first radiation delivery position or orientation, such as illustrated in FIGS. 1A, 1B and 1C, one hundred eighty (180) degrees to a second radiation delivery position or orientation, such as illustrated in FIG. 1D, of a plurality of radiation delivery positions or orientations, for example. Irradiation of the product sample 602 by the single radiation source 601 at a plurality of radiation delivery positions or orientations, such as the first radiation delivery position or orientation, such as illustrated in FIG. 1B, and at the second radiation delivery position or orientation, such as illustrated in FIG. 1D, facilitates a substantially uniform irradiation from the front side 611 to the back or rear side 612 of the product sample 602, and compensates for the product sample 602 attenuation of X-ray beam, such as the X-ray beam 8, after a short depth penetration.

In embodiments of the irradiator apparatus or system 600, as described, the reflector assembly 603 can be formed in two parts, with the first part or portion 621, such as a cradle 621, attached to a turntable assembly forming the sample holder 605, and the second part or portion 622, a mobile reflector 622, of the reflector assembly 603 configured to selectively slide laterally away from and toward the cradle 621 driven by the shaft assembly 607 associated with the lead screw assembly 668 on the linear rail carriage 664 positioned in sliding relation on the pair of linear rails 666, controlled and driven by the motor 614 in a linear motion, to allow space for rotation or orientation of the product sample 602. Shaft assembly 607 can desirably have screw indents and slides precisely and desirably using the stepper motor 614 and suitable bearings as known in the art on a linear guide, with a limit switch detect, such as a limit switch 660 to detect the product sample container 602*a* or a limit switch 662 to detect a syringe or similar configured product sample container, to ensure that a correct or acceptable distance or position of the opening and closing of the second part or portion 622 is achieved or facilitated for the second part or portion mobile reflector 622.

The reflector assembly 603 can include a metal holder 623 that attaches to the mobile reflector 622 and to a moving bearing of the shaft assembly 607 associated with the lead screw arrangement 668 to ensure substantially full movement of the mobile reflector 622. Mobile reflector 622 when closed with the cradle 621 constitutes a closed hollow cylinder cover with walls having a suitable thickness, such as a one inch thickness or more, for example, to provide a relatively effective reflector assembly 603. The cradle 621 is rotated or oriented, such as by using a bearing mounted to the rotation device 605*a* driven by the shaft assembly 606 and the motor 613. The rotation device 605*a* desirably can be a worm gear and worm. However, spur gears, miter gears, bevel gears, a chain and sprocket or direct drive could be used for or included in the rotation device 605*a*, for example, as can depend on the use or application, and should not be construed in a limiting sense.

Similar to embodiments of the irradiator apparatus or system 100 of FIG. 2B, embodiments of the irradiator apparatus or system 600 include the reflector assembly 603 having the cradle 621 including cradle sides 624 each respectively attached on both sides of the cradle 621 to maintain a product sample canister or container 626, generically referred to as the product sample canister or container 602*a*, that receives or includes the product sample 602 in position during rotation or orientation of the sample holder 605 to position the product sample 602 in one or more positions or orientations for radiation delivery, as described. The cradle sides 624 are desirably made of thin materials (of a 1 mm thickness, for example), such as polystyrene or acrylic (Polymethyl methacrylate, PMMA), or fiberglass to allow sturdiness while having a lower X-ray absorption. The product sample canister or container 626 desirably can include an aperture 626*a*, such as of a generally U-Shaped configuration, which generally U-Shaped configuration can extend into a lid 627 of the product sample canister or container 626. The aperture 626*a* is configured to receive a cylindrical shaped product sample container, such as can be a syringe full of blood or blood products as the product sample 602, for irradiation by the irradiator apparatus or system 600.

Also, the product sample canister or container 626 can also have other types of product samples 602 placed inside the product sample canister or container 626, such as by removing the lid 627 and then placing the product sample canister or container 626 in association with the sample holder 605, for example. Also, the mobile reflector 622 of the reflector assembly 603 can have a corresponding aperture 622*a* that aligns with the aperture 626*a*, when included in the product sample canister or container 626*a*, when the mobile reflector 622 is moved to a position aligned with the cradle 621, for example. Also, the mobile reflector 603 can be configured similar to the mobile reflector 22 of the reflector assembly 3 and the cradle 621 can be constructed similar to the cradle 21, similar to that illustrated in FIG. 2A, for example.

Also, it is desirable for the product sample canister or container 626 and the lid 627 to be secured to each other with a suitable locking mechanism 627*a*, such as latches or a latch mechanism 627*a*, to keep product samples 602 in place during rotation or orientation of the product sample canister or container 626. Also, the product sample canister or container 626 can, in addition to having a generally cylindrical shape or configuration, can also have an oval or ellipsoidal shape or configuration, or other suitable configuration, and such latches 627*a* can be designed to fit, for example, in a disc shape, to allow or facilitate relatively easy sliding of the product sample canister or container 626 into the cradle 621 and to be surrounded by the mobile reflector 622 of reflector assembly 603. The product sample canister or container 626 can hold liquid specimens or bags of liquids such as blood products, or live laboratory animals such as mice, or biological samples such as tissue or bone, etc. as the product sample 602, for example. Also, what constitutes the product sample 602 can be any of various suitable samples, as can be various materials, liquids, objects, compositions, organisms, etc., as can depend on the use or application, and should not be construed in a limiting sense. One application, among others, is use of embodiments of irradiator apparatus and systems, such as the irradiator apparatus or system 600, to irradiate blood for the prevention of Transfusion Associated Graft-Versus-Host Disease (TA-GvHD), for example.

The irradiator apparatus or system 600 desirably also includes a suitable controller/processor 615 that is communicatively associated with a suitable memory 616 for operation and control of the irradiator apparatus or system 600 and recording and monitoring of the radiation delivery process to the product sample 602, the controller/processor 615 and the suitable memory 616 can be powered by a suitable power source, such as the power source 609. The controller/processor 615 that is communicatively associated with the memory 616 can be associated with or a part of the network N for providing a controlled workflow for radiation delivery by embodiments of irradiator apparatus or systems, such as the irradiator apparatus or system 600. As illustrated in FIG. 6, similar to FIG. 1A, the network N can include the controller/processor 615 and the memory 616, and a suitable interface 617 as can include one or more of a suitable display, keyboard or touchpad, for example, for communication and control of the radiation delivery. The network N can include one or more of an external or an internal network 618, similar to the network 18, communicating with the controller/processor 615 and the memory 616 though the interface 617. The external or internal network 618 can include one or more networks 618 as can include a data storage/memory 618*a*, similar to the memory 18*a*, as can communicate with one or more controllers/processors 618*c*, similar to the controllers/processor 18*c*, through one or more suitable interfaces 618*b*, similar to the interface 18*b*, as can include one or more of a suitable display, keyboard or touchpad, for example. The controlled workflow as can be implemented through the network N to control a radiation amount to be delivered to the product sample 602, desirably including beam on-time control, synchronization with sample holder and reflector assembly movement, and dose data recording and processing through the network 618, for example, is discussed further herein with reference to FIG. 5.

The controller/processor 615, the memory 616, the internal/external network 618 including the data storage/memory 618*a* as can communicate with one or more controller/processors 618*c* through one or more suitable interfaces 618*b* for a controlled workflow for the radiation delivery by the irradiator apparatus or system 600, can represent, for example, a stand-alone computer, computer terminal, portable computing device, networked computer or computer terminal, or networked portable device, such as a cell phone, tablet, pad or other wireless communication device. Data and control information for the radiation delivery, monitoring and recording can be entered into the network N for radiation delivery by the irradiator apparatus or system 600 by a user or operator of the irradiator apparatus or system 600 or the associated network N via any suitable type of user interface 617, 618*b*, and can be stored in computer readable memories, such as the memory 616, 618*a*, which may be any suitable type of computer readable and programmable memory. Calculations, processing and analysis are performed by the controller/processor 615, 618*c*, or other processors of system components of the irradiator apparatus or system 600 and the associated network N, which can be any suitable type of computer processor, and can be displayed to the user on the interface display of the interface 617, 618*b*, either of which can be any suitable type of computer/processor or networked portable device, as can have a suitable display, for example.

The controller/processor components of the irradiator apparatus or system 600 and of the associated network N including the controller/processor 615, 618*c*, and other controllers/processors of the network N can be associated with, or incorporated into, any suitable type of computing device, for example, a personal computer or a programmable logic controller (PLC) or an application specific integrated circuit (ASIC) as can include hardware, software and firmware for the radiation delivery, monitoring and recording process. The interface/display 617, 618*b*, the controller/processor components of the irradiator apparatus or system 600 as can include the associated network N, including the controller/processor 615, the memory 616 and the data storage/memory 618*a* and the controller/processor 618*c* of the network 618, and any associated computer readable media are in communication with one another by any suitable type of data bus or other wired or wireless communication, as is well known in the art.

Examples of computer readable media include a magnetic recording apparatus, non-transitory computer readable storage memory, an optical disk, a magneto-optical disk, and/or a semiconductor memory (for example, RAM, ROM, etc.). Examples of magnetic recording apparatus that may be used as or in addition to memory 616, the data storage/memory 618*a* and other data storage components of the irradiator apparatus or system 600 and the associated network N, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Referring now to FIG. 5, there is illustrated a process flow diagram 500 of embodiments of irradiation processes and methods for irradiation of the product sample 2, 602 using an embodiment of the irradiator apparatus or system 600 of FIG. 6, corresponding to embodiments of the irradiator apparatus or system 100 of FIGS. 1A-1D, and using the irradiator apparatus or system 100 of FIGS. 1A-1D. The process flow 500 includes a controlled workflow to control a radiation amount to be delivered to a product sample 2, 602 illustrating embodiments of operation methods of the irradiator apparatus or system 100, 600, wherein a product sample 2, 602 is desirably irradiated in a controlled workflow, including beam On-time control, synchronization with sample holder and reflector movement, and dose data recording and processing through a network, such as the network N. The workflow desirably can also incorporate or include timer setting and irradiator and radiation dose data recording, transfer through a network, such as the network N, and data printing and reporting, for example.

Referring now to FIGS. 1A-1D, 2A-2D, 3A-3C, 5 and 6, embodiments of the process 500 for irradiation of the product sample 2, 602 and for a controlled workflow to control a radiation amount to be delivered to the product sample 2, 602 begins at step 502. At step 502, the controller/processor 15, 18*c*, 615, 618*c* initiates opening an irradiation session from a computer controlled console and selecting and entering irradiation parameters for radiation delivery to the product sample 2, 602, such irradiation parameters can include, for example, a delivered dose or an irradiation time, as well as a dose rate or high voltage X-ray tube settings, such as setting a current and voltage, can be entered.

The process 500 then proceeds to step 504 of placing the product sample 2, 602 into an irradiation canister or container, such as the product sample canister or container 2*a*, 602*a*, 626. The process 500 then proceeds to step 506 of placing the product sample canister or container 2*a*, 602*a*, 626 including the product sample 2, 602 into the sample holder 5, 605, as can be associated with the reflector assembly 3, 603 inside an irradiation chamber (the interior of the irradiator apparatus or system 100, 600) of the irradiator apparatus or system 100, 600, such as by opening the sliding door or cover of the irradiator apparatus or system 100, 600, and positioning the product sample canister or container 2*a*, 602*a*, 626 including the product sample 2, 602 in association with the sample holder 5, 605. The process 500 then proceeds to step 508 of closing the sliding door or cover of the irradiation chamber of the irradiator apparatus or system 100, 600 and automatically moving, such as under control of the controller/processor 15, 18*c*, 615, 618*c*, a movable reflector 22, 622 of the reflector assembly 3, 603 to fully surround the product sample canister or container 2*a*, 602*a*, 626 including the product sample 2, 602, such as by moving the second part or portion 22, 622 of the reflector assembly 3, 603 toward the first part or portion 21, 621 of the reflector assembly 3, 603 that is in communication with the product sample canister or container 2*a*, 602*a*, 626 including the product sample 2, 602.

The process 500 then proceeds to step 510 of verifying, such as under control of the controller/processor 15, 18*c*, 615, 618*c*, the presence of the product sample canister or container 2*a*, 602*a*, 626 including the product sample 2, 602 in the sample holder 5, 605, as can be associated with the reflector assembly 3, 603 inside an irradiation chamber (the interior of the irradiator apparatus or system 100, 600) of the irradiator apparatus or system 100, 600, such as by the limit switches 660, 662 and then turning on the X-ray tube or source 1, 601, such as under control of the controller/processor 15, 18*c*, 615, 618*c*, to generate radiation to irradiate the product sample 2, 602.

The process 500 then proceeds to step 512 of irradiating the product sample 2, 602, such as under control of the controller/processor 15, 18*c*, 615, 618*c*, for a predetermined time, such as for a half set time of a total irradiation time, by the generated radiation that has passed through the filter 30, 32, 33, 630, and then through the front side 11, 611 of the product sample canister or container 2*a*, 602*a*, 626 including the product sample 2, 602.

The process 500 then proceeds to step 514 of automatically turning off the radiation source 1, 601, such as the X-ray tube 1, 601, and automatically sliding of the second part or portion 22, 622 of the reflector assembly 3, 603 away from the first part or portion 21, 621 of the reflector assembly 3, 603 that is in communication with the product sample canister or container 2*a*, 602*a*, 626 including the product sample 2, 602 until the limit switches 660, 662 detect the second part or portion 22, 622 of the reflector assembly 3, 603 is positioned away from the first part or portion 21, 621 of the reflector assembly 3, 603 and away from the product sample canister or container 2*a*, 602*a*, 626 including the product sample 2, 602.

The process 500 then proceeds to step 516 of automatically rotating or orienting by the rotation device 5*a*, 605*a*, such as under control of the controller/processor 15, 18*c*, 615, 618*c*, the sample holder 5, 605 to selectively rotate, flip or orient the product sample canister or container 2*a*, 602*a*, 626 and the product sample 2, 602 by one hundred eighty (180) degrees from the front side 11, 611 position or orientation of the product sample canister or container 2, 602*a*, 626 including the product sample 2, 602 to the rear side 12, 612 position or orientation of the product sample canister or container 2*a*, 602*a*, 626 including the product sample 2, 602 so that the rear side 12, 612 of product sample container 2*a*, 602*a*, 626 including the product sample 2, 602 is now positioned in facing relation to the radiation beam, such as the radiation beam 8, generated by the single radiation source 1, 601, for example.

The process 500 then proceeds to step 518 of automatically sliding of the second part or portion 22, 622 of the reflector assembly 3, 603 again toward the first part or portion 21, 621 of the reflector assembly 3, 603 that is in communication with the product sample canister or container 2*a*, 602*a*, 626 including the product sample 2, 602 until the limit switches 660, 662 detect the second part or portion 22, 622 of the reflector assembly 3, 603 is in a position over or in communication with the first part or portion 21, 621 of the reflector assembly 3, 603 and over or in surrounding relation to the product sample canister or container 2*a*, 602*a*, 626 including the product sample 2, 602, such as under control of the controller/processor 15, 18*c*, 615, 618*c*, for example.

The process 500 then proceeds to step 520 of again automatically continuing irradiating the product sample 2, 602, such as under control of the controller/processor 15, 18*c*, 615, 618*c*, for a predetermined another time, such as for a remaining half set time of a total irradiation time, by the generated radiation that has passed through the filter 30, 32, 33, 630, and then through the rear side 12, 612 of the product sample canister or container 2*a*, 602*a*, 626 including the product sample 2, 602, for example.

The process 500 then proceeds to step 522 of automatically turning off the radiation source 1, 601, such as the X-ray tube 1, 601, and automatically sliding of the second part or portion 22, 622 of the reflector assembly 3, 603 away from the first part or portion 21, 621 of the reflector assembly 3, 603 that is in communication with the product sample canister or container 2*a*, 602*a*, 626 including the product sample 2, 602 until the limit switches 660, 662 detect the second part or portion 22, 622 of the reflector assembly 3, 603 is positioned away from the first part or portion 21, 621 of the reflector assembly 3, 603 and away from the product sample canister or container 2*a*, 602*a*, 626 including the product sample 2, 602, such as under control of the controller/processor 15, 18*c*, 615, 618*c*, for example.

The process 500 then proceeds to step 524 of opening the sliding door or cover of the irradiation chamber of the irradiator apparatus or system 100, 600, such as can be under control of the controller/processor 15, 18*c*, 615, 618*c*, and removing the product sample canister or container 2*a*, 602*a*, 626 including the now irradiated product sample 2, 602 from the irradiator chamber of and from the irradiator apparatus or system 100, 600, for example.

The process can then desirably proceed to step 526 of displaying or providing, such as under control of the controller/processor 15, 18*c*, 615, 618*c*, the final machine session parameters, such as can be stored in the memory 16, 18*a*, 616, 618*a*, for the radiation delivery, such as being displayed or provided on a control console screen, such as on the interface 17, 18*b*, 617, 618*b*, such parameters as can include confirmation of successful completion of the irradiation, the irradiation set time, the actual irradiation time and the radiation beam or X-ray beam parameters as set during opening of the irradiation session for irradiation the product sample 2, 602 by the irradiator apparatus or system 100, 600, for example.

The process can then also desirably proceed to step 528 of logging the session parameters in an internal data base of the irradiator apparatus or system 100, 600 or of the network N, such as can be provided by the memory 16, 18*a*, 616, 618*a* under control of the controller/processor 15, 18*c*, 615, 618*c*, and such parameters can also desirably be one or more of printed, such as by a printer, and transferred through the network N to a remote LIMS (Laboratory Information Management System), for example, such as thorough the interface 17, 18*b*, 617, 618*b*, to suitable data storage, such as stored in the memory 16, 18*a*, 616, 618*a*, under control of the controller/processor 15, 18*c*, 615, 618*c*, for later review, record-keeping and analysis, for example. Also, in step 528, the irradiation session parameters can be optionally printed so as to provide a printout of the irradiation session parameters on a label to be attached to the irradiated product sample 2, 602 or its product sample canister or container 2*a*, 602*a*, 626, for example. The process 500 then proceeds to step 530 to end the irradiation cycle and can then selectively return to step 502 for a new product sample irradiation session.

Embodiments of the described irradiator apparatus and systems, such as irradiator apparatuses and systems 100 and 600, can be desirable and advantageous in their use of a single radiation source, such as an X-ray tube. Such irradiator apparatuses and systems by using a single radiation source, such as a single X-ray tube for radiation delivery for irradiation of the product sample, can desirably have a relatively more compact design and relatively increased portability for use in smaller rooms, as compared to known two X-ray source irradiators, such as a Raycell MK2 model irradiator, which includes two X-ray tubes for delivery of radiation to a product sample, for example.

Also, embodiments of the described irradiator apparatus and systems, such as the irradiator apparatuses and systems 100 and 600, can desirably simplify cooling system requirements for the irradiator apparatus or system, such as in relation to external cooling using a continuous water supply or an external refrigeration system, for example. Also, by using only a single radiation source, such as a single X-ray tube, for irradiation of the product sample, embodiments of the irradiator apparatuses and systems, such as the irradiator apparatuses and systems 100 and 600, desirably can consume relatively less power and can use a relatively small and efficient integrated cooling system, such as a closed loop liquid circulating system with or without air ventilation to facilitate achieving the required cooling and heat transfer to operate the single irradiation source, such as a single X-ray tube, at relatively high power and at room temperature, for example.

It is to be understood that the present invention is not limited to the embodiments described above, but encompasses any and all embodiments within the scope of the following claims.

We claim:

1. An irradiator apparatus for radiation delivery, comprising:

a single X-ray source for generating radiation in an X-ray beam to irradiate a product sample;

an X-ray filter to filter the radiation generated by the single X-ray source prior to delivery of the generated radiation in the X-ray beam to the product sample;

a reflector assembly to reflect radiation delivered by the single X-ray source to the product sample back to the product sample; and a rotation device associated with a sample holder configured to support the product sample and configured to rotate, flip or orient the product sample to a plurality of positions or orientations for delivery of radiation from the single X-ray source to the product sample at each of the plurality of positions or orientations to facilitate a substantially uniform irradiation of the product sample and a substantially uniform radiation exposure delivered to the product sample providing a substantial dose profile uniformity in the irradiated product sample.

2. The irradiator apparatus according to claim 1, wherein the reflector assembly comprises:

a first part or portion communicatively associated with the sample holder and the rotation device to position and support the product sample at a corresponding one of the plurality of positions or orientations for delivery of radiation to the product sample; and a second part or portion configured to selectively move out of and into communication with the first part or portion of the reflector assembly to allow a space for rotation or orientation of the product sample to the corresponding one of the plurality of positions or orientations for delivery of radiation to the product sample.

3. The irradiator apparatus according to claim 2, further comprising:

a first shaft assembly communicatively associated with the rotation device to selectively rotate the sample holder and the first part or portion of the reflector assembly to drive the rotation device to move the rotation device to position the product sample at the corresponding one of the plurality of positions or orientations for delivery of radiation to the product sample; and a second shaft assembly communicatively associated with the second part or portion of the reflector assembly to drive the selective movement of the second part or portion of the reflector assembly out of and into communication with the first part or portion of the reflector assembly.

4. The irradiator apparatus according to claim 1, wherein:

the reflector assembly comprises a material of a low-Z atomic number and a high density material composition to facilitate X-ray radiation reflection and sample irradiation.

5. The irradiator apparatus according to claim 4, wherein:

the material of a low-Z atomic number comprises a material selected from the group of consisting of beryllium, boron, carbon, and combination thereof.

6. The irradiator apparatus according to claim 1, wherein:

the X-ray filter comprises a metal of a thickness to reduce low-energy X-rays and facilitate less attenuation of the generated X-ray beam to provide a substantially homogeneous dose distribution laterally and at depth throughout the irradiated product sample.

7. The irradiator apparatus according to claim 1, wherein:

the X-ray filter comprises copper having a generally flat sheet configuration having a thickness in a range of about 75 microns to 130 microns to facilitate low-energy X-ray beam filtration and beam depth penetration of the irradiated product sample.

8. The irradiator apparatus according to claim 1, wherein:

the X-ray filter comprises one or more metallic sheets formed in a step configuration to facilitate a selective spatial filtration of the generated X-ray beam and to attenuate the generated X-ray beam at a beam center to provide a substantially homogeneous and uniform dose distribution in the irradiated product sample.

9. The irradiator apparatus according to claim 8, wherein:

the one or more metallic sheets forming the X-ray filter comprise a material selected from the group consisting of aluminum, tungsten, copper and heavy metals, or combinations thereof.

10. The irradiator apparatus according to claim 8, wherein:

the X-ray filter comprises a material composition having a single layer configuration or a multi-layer combination configured to provide a substantially homogeneous and uniform dose distribution in the irradiated product sample.

11. An irradiator apparatus for radiation delivery, comprising:

a single radiation source for generating radiation in a radiation beam to irradiate a product sample;

a filter to filter the radiation generated by the single radiation source prior to delivery of the generated radiation in the radiation beam to the product sample;

a reflector assembly to reflect radiation delivered by the single radiation source to the product sample back to the product sample; and a rotation device associated with a sample holder configured to support the product sample and configured to rotate, flip or orient the product sample to a plurality of positions or orientations for delivery of radiation from the single radiation source to the product sample at each of the plurality of positions or orientations to facilitate a substantially uniform irradiation of the product sample and a substantially uniform radiation exposure delivered to the product sample providing a substantial dose profile uniformity in the irradiated product sample.

12. A method for irradiating a product sample, comprising:

positioning a product sample to be irradiated in a product sample container or canister;

positioning the product sample container or canister in a sample holder at an initial position or orientation in an irradiator apparatus;

irradiating the product sample positioned in the product sample container or canister by generating radiation from a single radiation source in the irradiator apparatus and delivering the generated radiation to the product sample positioned at the initial position or orientation;

reflecting the radiation delivered to the product sample at the initial position or orientation back to the product sample by a reflector assembly in the irradiator apparatus;

selectively positioning the product sample and the product sample container or canister positioned in the sample holder at one or more other positions or orientations;

generating radiation by the single radiation source and delivering the generated radiation to the product sample at the one or more other positions or orientations; and reflecting back to the product sample by the reflector assembly the generated radiation delivered to the product sample positioned at a corresponding position or orientation of the one or more other positions or orientations.

13. The method for irradiating a product sample according to claim 12, further comprising:

successively providing a plurality of radiation deliveries to the product sample first at the initial position or orientation and then at each of the one or more other positions or orientations to facilitate a substantially uniform irradiation of the product sample and a substantially uniform radiation exposure delivered to the product sample providing a substantial dose profile uniformity in the irradiated product sample.

14. The method for irradiating a product sample according to claim 12, further comprising:

selectively moving at least a part the reflector assembly away from the product sample container or canister to position or orient the product sample container or canister at the initial position or orientation or at the one or more other positions or orientations; and rotating or orienting the product sample container or canister including the product sample, after at least the part the reflector assembly has moved away from the product sample container or canister, to position the product sample container or canister including the product sample at the initial position or orientation or at a corresponding position or orientation of the one or more other positions or orientations for irradiation of the product sample.

15. The method for irradiating a product sample according to claim 12, further comprising:

filtering the radiation generated by the single radiation source by a filter prior to delivery of the radiation to the product sample to facilitate dose uniformity in the irradiated product sample.

16. The method for irradiating a product sample according to claim 12, wherein:

the single radiation source comprises an X-ray source.

17. A method for controlling irradiation of a product sample in an irradiator system, comprising:

providing a controlled workflow to control a radiation amount to be delivered to a product sample at each of a plurality of radiation deliveries by a single radiation source in a radiation apparatus to provide a total radiation amount delivered to the product sample for the plurality of radiation deliveries having a substantial dose profile uniformity in the irradiated product sample, the radiation apparatus being configured to position the product sample in the radiation apparatus for radiation delivery to the product sample;

determining a beam on-time in the controlled workflow for each of the plurality of radiation deliveries corresponding to a radiation amount to be delivered to the product sample at each of the plurality of radiation deliveries by the single radiation source;

determining in the controlled workflow a position or orientation of the product sample for each of the plurality of radiation deliveries;

synchronizing in the controlled workflow movements of a sample holder configured to hold the product sample to be irradiated, movements of at least a portion of a reflector assembly, the reflector assembly being positioned in the radiation apparatus and configured to reflect back to the product sample the radiation delivered from the single radiation source, and the determined beam on-time for each of the plurality of radiation deliveries to deliver radiation to the product sample at each corresponding one of the plurality of radiation deliveries; and controlling the single radiation source in the controlled workflow to deliver radiation to the product sample for each corresponding determined beam on-time for each of the plurality of radiation deliveries at each corresponding determined position or orientation of the product sample to provide a substantially uniform irradiation of the product sample and a substantially uniform radiation exposure delivered to the product sample to provide a substantial dose profile uniformity in the irradiated product sample.

18. The method for controlling irradiation of a product sample in an irradiator system according to claim 17, further comprising:

providing on-time control and synchronization of radiation delivery with the sample holder and the reflector assembly movement.

19. The method for controlling irradiation of a product sample in an irradiator system according to claim 17, further comprising:

setting a timer to time each set time corresponding to the beam on-time for radiation delivery at each of the plurality of radiation deliveries by the single radiation source.

20. The method for controlling irradiation of a product sample in an irradiator system according to claim 17, further comprising:

transferring data for radiation delivery through a network; and storing the transferred data corresponding to the radiation delivery in a data storage associated with the network.

21. The method for controlling irradiation of a product sample in an irradiator system according to claim 20, further comprising:

reporting the data for the radiation delivery through the network to one or more users of the network.

22. The method for controlling irradiation of a product sample in an irradiator system according to claim 20, further comprising:

printing at least a portion of the data corresponding to the radiation delivery on a label; and placing the label having the printed data in association with the irradiated product sample.

* * * * *